US011867437B2

(12) United States Patent
Elliott et al.

(10) Patent No.: US 11,867,437 B2
(45) Date of Patent: Jan. 9, 2024

(54) HVAC DUAL DE-SUPERHEATING/SUBCOOLING HEAT RECLAIM SYSTEM FOR TRANSCRITICAL REFRIGERATION SYSTEMS

(71) Applicant: Flo Energy Solutions Inc., Toronto (CA)

(72) Inventors: Bryan Elliott, Toronto (CA); Saman Zamanzadeh Haratbar, Newmarket (CA); Laura Janke Semidey, Woodstock, GA (US); Jon Scott Martin, Conyers, GA (US)

(73) Assignee: Flo Energy Solutions Inc., Toronto (CA)

( * ) Notice: Subject to any disclaimer, the term of this patent is extended or adjusted under 35 U.S.C. 154(b) by 0 days.

(21) Appl. No.: 17/732,172

(22) Filed: Apr. 28, 2022

(65) Prior Publication Data

US 2022/0357084 A1 Nov. 10, 2022

Related U.S. Application Data

(60) Provisional application No. 63/181,530, filed on Apr. 29, 2021.

(51) Int. Cl.
*F25B 40/04* (2006.01)
*F25B 41/20* (2021.01)
(Continued)

(52) U.S. Cl.
CPC ..... *F25B 40/04* (2013.01); *F25B 5/02* (2013.01); *F25B 9/008* (2013.01); *F25B 41/22* (2021.01);
(Continued)

(58) Field of Classification Search
CPC ..... F25B 5/02; F25B 9/008; F25B 25/005; F25B 40/02; F25B 40/04; F25B 43/00;
(Continued)

(56) References Cited

U.S. PATENT DOCUMENTS 4,711,094 A 12/1987 Ares et al.
10,578,343 B2 3/2020 Lesage et al.
(Continued)

FOREIGN PATENT DOCUMENTS

CA 2807643 A1 8/2013

OTHER PUBLICATIONS

"Purity Plus HVAC", LMP, May 21, 2021, 8 pages.

*Primary Examiner* — Jonathan Bradford
(74) *Attorney, Agent, or Firm* — Dorsey & Whitney LLP

(57) ABSTRACT

A dual reclaim coil with a smart control application is provided that allows the refrigerant inlet to the HVAC unit switch between the two sides of the condenser for heat reclaim for refrigerants such as $CO_2$ which have a relatively low critical temperature compared to hydrofluorocarbon refrigerants. Heat reclaim after the exit of gas from the condenser utilizes the high temperature and pressure of the condenser/gas cooler outlet while a $CO_2$ refrigerant system is operating above critical point. This occurs in hot ambient conditions, when the need for heating in the space is not as great as in the wintertime and the available heat at the condenser/gas cooler's outlet is sufficient to satisfy the heating load. When the $CO_2$ refrigerant system is operating below the critical point, heat reclaim is carried out at the compressor discharge.

21 Claims, 8 Drawing Sheets

(51) Int. Cl.

| | |
|---|---|
| ***F25B 49/02*** | (2006.01) |
| ***F25B 9/00*** | (2006.01) |
| ***F25B 41/22*** | (2021.01) |
| ***F25B 5/02*** | (2006.01) |

(52) U.S. Cl.
CPC ..... *F25B 49/027* (2013.01); *F25B 2309/06* (2013.01); *F25B 2400/22* (2013.01); *F25B 2600/2503* (2013.01)

(58) Field of Classification Search
CPC ..... F25B 49/027; F25B 2309/06; F25B 2309/061; F25B 2400/0409; F25B 2400/22; F25B 2400/23; F25B 2600/2503; F25B 2700/13; F25B 2700/2101
See application file for complete search history.

(56) References Cited

U.S. PATENT DOCUMENTS

| | | | | |
|---|---|---|---|---|
| 2016/0010904 | A1 | 1/2016 | Kantchev | |
| 2020/0124330 | A1* | 4/2020 | Hayes | F25B 49/02 |

* cited by examiner

HVAC DUAL DE-SUPERHEATING/SUBCOOLING HEAT RECLAIM SYSTEM FOR TRANSCRITICAL REFRIGERATION SYSTEMS

TECHNICAL FIELD

The application is directed generally to heat reclamation in refrigeration and HVAC systems.

BACKGROUND

Refrigeration systems in the nature of refrigerator units and freezers are important appliances in supermarkets for maintaining perishable food items at a required temperature. In a supermarket, a refrigeration system's heat of rejection, which is normally expelled and wasted at a condenser, can be recovered. Refrigeration systems are low-to-medium temperature sources within the supermarket, and as such, heat reclaim can be used throughout the year for space heating, water heating, or some other useful purpose. Hydrofluorocarbon (HFC) refrigerants are the most commonly used refrigerant type in supermarket refrigeration systems. Due to the recognized Ozone Depleting Potential (ODP) and Global Warming Potential (GWP) of HFCs, a phase out schedule has been implemented in parts of the world including North America and the European Union. As a result, manufacturers are now increasingly moving towards more environmentally friendly alternatives, especially natural refrigerants with significantly lower GWP and ODP measures.

In recent years, this advancement has led to the installation of numerous refrigeration systems using natural refrigerant such as carbon dioxide (R-744) as a refrigerant. In addition to being less harmful to the environment, the high index of compression for R-744 and higher discharge temperature compared to that of HFCs can improve heat reclamation potential in retail applications.

A major distinction between R-744 and HFC refrigerants is higher operating pressures as well as a relatively lower critical temperature of R-744 compared to HFC refrigerants. If the ambient temperature is high enough and the gas cooler/condenser's temperature is above the critical point of the refrigerant, the temperature of the gas cooler/condenser in an air-cooled refrigeration system will be above the critical point and the outlet of the gas cooler will be a mixture of vapor-liquid called supercritical fluid. The efficiency of a refrigeration system above the critical point is lower than in subcritical mode where the condensing temperature is below critical point, and a full phase change occurs in the condenser.

On the other hand, a R-744 system has a relatively higher operating pressure-temperature compared to HFCs. If certain indoor and outdoor conditions are met, the heat could be recovered from the outlet of the condenser (gas cooler) instead of the compressor discharge. Recovering heat energy from the compressor discharge gas captures heat that would be otherwise wasted. Recovering heat energy after the exit of the gas cooler captures heat that must be eventually removed by an input of electric work done by the compressor. Hence the heat removal from the gas cooler outlet increases the efficiency (measured as COP) of the transcritical system by subcooling the gas before being sent to the expansion device. COP is a ratio of useful heating or cooling provided to work (energy) required. Higher COPs equate to higher efficiency, lower energy (power) consumption and thus lower operating costs.

Heat reclamation for the purpose of space heating has been used in supermarkets for decades. It captures heat from a discharge line where the temperature and pressure of the refrigerant gas are at a maximum point in the cycle, simply becoming another condenser (or de-superheater) for the refrigeration system. These heat reclaim coils recover a portion of the heat that would otherwise be rejected to the outside of the building. Commonly used $CO_2$ heat reclaim coils are no exception.

Typically, the application for heat reclaim systems is more favorable in cold climates where the space heating requirement is high and limited in hot climates because the need for space heating is not high enough to justify the capital investment.

There is a need for a dual heat reclaim coil and a control strategy in a supermarket type environment, specific to refrigeration systems that have high operating pressure and low critical temperature which results in a transcritical operation in high ambient temperatures. $CO_2$ is the most common example of such a refrigerant. The concept is rooted in the major difference in properties between natural refrigerants such as R-744 and HFC refrigerants that provides a unique opportunity to recover heat from the refrigeration system with a different method when the ambient temperature is high. There is a need to increase a refrigeration system's efficiency by subcooling the refrigerant, then switching back to its normal operation when the ambient temperature drops. Such a dual heat reclamation system employed with an effective control strategy is needed to increase the overall refrigeration system's efficiency and also to expand the use of heat reclaim coils to hot and humid areas where the low Heating Degree Days (HDD) currently do not justify the additional cost involved in installing a reclaim system.

SUMMARY

A dual reclaim coil with a smart control application is provided that allows the refrigerant inlet to a heat reclaim coil in a HVAC unit to switch between two sides of a gas cooler/condenser. The application uses the high temperature and pressure of the condenser/gas cooler outlet while a $CO_2$ refrigerant system is operating near or above the critical point of the refrigerant. This occurs in hot ambient conditions, when the need for heating in the space is not as great as in the wintertime and the available heat at the condenser/gas cooler's outlet is sufficient to satisfy the heating load. This also mitigates space overcooling, while increasing the $CO_2$ transcritical system's efficiency by subcooling the refrigerant for applications involving dehumidification HVAC systems which often results in a phenomenon called "overcooling" during the dehumidification season. Overcooling can also be amplified in a supermarket environment due to spillage of the cold air from refrigeration cases.

In addition to dehumidification systems, a dual reclaim coil can be used in a heating only unit as well. This dual reclaim coil can switch the refrigerant inlet point between a compressor discharge and a condenser/gas cooler exit depending on the ambient temperature and required heat for the space. This application is useful when space overcooling occurs due to spillage from refrigeration cases, for example.

According to one aspect, there is provided a refrigeration system comprising a condenser; an expansion valve; an evaporator; a compressor; a refrigerant having a critical temperature of less than 95° F.; a refrigerant conduit defining a cyclic flow path for the refrigerant from the condenser to the expansion valve to the evaporator to the compressor and back to the condenser; a compressor valve located in the refrigerant conduit at a position between the compressor and the condenser; a condenser outlet valve located in the refrigerant conduit at a position between the condenser and the expansion valve; a reclaim coil; a first reclaim coil conduit defining a flow path for the refrigerant from the compressor valve through the reclaim coil and then to the refrigerant conduit at a position between the compressor valve and the condenser whereby the refrigerant flows from the first reclaim coil conduit into the refrigerant conduit and then to the condenser through the refrigerant conduit; a second reclaim coil conduit defining a flow path for the refrigerant from the condenser outlet valve through the reclaim coil to the refrigerant conduit at a position between the condenser outlet valve and the expansion valve whereby the refrigerant flows from the second reclaim coil conduit into the refrigerant conduit and then to the expansion valve through the refrigerant conduit; at least one of a temperature sensor for measuring a temperature of ambient air in a space in which the refrigeration system is located, a temperature sensor for measuring a temperature of the refrigerant and a temperature and pressure sensor for measuring a temperature and pressure of the refrigerant and a controller operatively connected to at least one of the temperature sensor for measuring the temperature of ambient air in a space in which the refrigeration system is located, the temperature sensor for measuring the temperature of the refrigerant and the temperature, the pressure sensor for measuring a temperature and pressure of the refrigerant, and a discharge pressure sensor and suction pressure sensor for the HVAC system. The controller further being operatively connected to the compressor valve and the condenser outlet valve for selectively operating the compressor valve and the condenser outlet valve between first and second positions in response to at least one of a temperature reading from the temperature sensor for measuring a temperature of ambient air in a space in which the refrigeration system is located, a temperature reading from the temperature sensor for measuring a temperature of the refrigerant and a temperature and a pressure reading from the temperature and a pressure sensor for measuring a pressure of the refrigerant.

The compressor valve directs a flow of the refrigerant through the first reclaim coil conduit when in the first position. The compressor valve directs the flow of the refrigerant through the refrigerant conduit to the condenser when said compressor valve is in the second position. The condenser outlet valve directs the flow of the refrigerant through the refrigerant conduit from the compressor to the expansion valve when said condenser outlet valve is in the first position. The condenser outlet valve directs a flow of the refrigerant through the second reclaim coil conduit when said condenser outlet valve is in the second position.

According to another aspect, there is provided a method of dual heat reclamation from a refrigeration system comprising the following steps: providing a condenser, an expansion valve, an evaporator, a compressor and a refrigerant conduit defining a cyclic flow path for the refrigerant from the condenser to the expansion valve to the evaporator to the compressor and back to the condenser; providing a reclaim coil and first and second reclaim coil conduits for connecting the reclaim coil to the condenser and to the refrigerant conduit, the first reclaim coil conduit being fluidly connected to the refrigerant conduit at a position between the compressor and the condenser, the first reclaim coil conduit defining a flow path from the refrigerant conduit through the reclaim coil and back to the refrigerant conduit at a second position between the compressor and the condenser, the second reclaim coil conduit being fluidly connected to the refrigerant conduit at a position between the condenser and the expansion valve, the second reclaim coil conduit defining a flow path from the refrigerant conduit through the reclaim coil and back to the refrigerant conduit at a second position between the condenser and the expansion valve; circulating a refrigerant having a critical temperature of less than 95° F. in the refrigerant conduit from the condenser to the to the expansion valve to the evaporator to the compressor and back to the condenser;

detecting at least one of a temperature of ambient air surrounding the refrigeration system, a temperature of the refrigerant at the condenser and a temperature and a pressure of the refrigerant at the condenser;

selectively directing a flow of the refrigerant through the first reclaim coil conduit when at least one of the temperature of the ambient air, the temperature of the refrigerant at the condenser and a temperature and the pressure of the refrigerant at the condenser detected is below the threshold (set point) dictated by the controller and the temperature and pressure of the fluid at the exit of the gas cooler are below a critical level, whereby the refrigerant is circulated to the reclaim coil and then to the condenser; and selectively directing a flow of the refrigerant through the second reclaim coil conduit when at least one of the temperature of the ambient air, the temperature of the refrigerant at the condenser and the temperature and pressure of the refrigerant at the condenser detected is above the threshold (set point) dictated by the controller, and the temperature and pressure of the refrigerant is above a critical level that requires subcooling, whereby the refrigerant is circulated to the condenser and then to the reclaim coil.

According to another aspect, there is provided a refrigeration system comprising: a condenser; an expansion valve; an evaporator; a compressor; a refrigerant having a critical temperature of less than 95° F.; a refrigerant conduit defining a cyclic flow path for the refrigerant from the condenser to the expansion valve to the evaporator to the compressor and back to the condenser; a compressor valve located in the refrigerant conduit at a position between the compressor and the condenser; a condenser outlet valve located in the refrigerant conduit at a position between the condenser and the expansion valve; a flash tank operating as a liquid/vapor separator, the flash tank being fluidly connected to the refrigerant conduit at a position between the expansion valve and the evaporator, the refrigerant conduit further defining bypass conduit for transmitting gas from the flash tank to the compressor; a reclaim coil; a first reclaim coil conduit defining a flow path for the refrigerant from the compressor valve through the reclaim coil and then to the refrigerant conduit at a position between the compressor valve and the condenser whereby the refrigerant flows from the first reclaim coil conduit into the refrigerant conduit and then to the condenser through the refrigerant conduit; a second reclaim coil conduit defining a flow path for the refrigerant from the condenser outlet valve through the reclaim coil to the to the refrigerant conduit at a position between the condenser outlet valve and the expansion valve whereby the refrigerant flows from the second reclaim coil conduit into the refrigerant conduit and then to the expansion valve through the refrigerant conduit; a mass flow sensor for measuring at least one of a temperature, pressure and mass flow of gas exiting the flash tank, the mass flow sensor being in fluid communication with the bypass conduit; a controller operatively connected to the mass flow sensor for measuring at least one of the temperature, pressure and mass flow of the gas, the controller further being operatively connected to the compressor valve and the condenser outlet valve for selectively operating the compressor valve and the condenser outlet valve between first and second positions in response to at least one of a temperature, pressure or mass flow reading from the mass flow sensor, said compressor valve directing a flow of the refrigerant through the first reclaim coil conduit when in the first position, said compressor valve directing the flow of the refrigerant through the refrigerant conduit to the condenser when said compressor valve is in the second position, said condenser outlet valve directing the flow of the refrigerant through the refrigerant conduit from the compressor to the expansion valve when said condenser outlet valve is in the first position, said condenser outlet valve directing a flow of the refrigerant through the second reclaim coil conduit when said condenser outlet valve is in the second position.

According to another aspect, there is provided a method of dual heat reclamation from a refrigeration system comprising the following steps: providing a condenser, an expansion valve; an evaporator and a compressor; providing a refrigerant conduit defining a cyclic flow path for a refrigerant from the condenser to the expansion valve to the evaporator to the compressor and back to the condenser; providing a compressor valve located in the refrigerant conduit at a position between the compressor and the condenser; providing a condenser outlet valve located in the refrigerant conduit at a position between condenser and the expansion valve; providing a flash tank operating as a liquid/vapor separator, the flash tank being fluidly connected to the refrigerant conduit at a position between the expansion valve and the evaporator, the refrigerant conduit further defining a bypass conduit for transmitting gas from the flash tank to the compressor; providing a reclaim coil; providing a first reclaim coil conduit defining a flow path for the refrigerant from the compressor valve through the reclaim coil and then to the refrigerant conduit at a position between the compressor valve and the condenser whereby the refrigerant flows from the first reclaim coil conduit into the refrigerant conduit and then to the condenser through the refrigerant conduit; providing a second reclaim coil conduit defining a flow path for the refrigerant from the condenser outlet valve through the reclaim coil to the refrigerant conduit at a position between the condenser outlet valve and the expansion valve whereby the refrigerant flows from the second reclaim coil conduit into the refrigerant conduit and then to the expansion valve through the refrigerant conduit; providing a mass flow sensor for measuring at least one of a temperature, pressure and mass flow of a gas exiting the flash tank, the mass flow sensor being in fluid communication with the bypass conduit; providing a controller operatively connected to the mass flow sensor for measuring at least one of the temperature, pressure and mass flow of the gas; circulating a refrigerant having a critical temperature of less than 95° F. through the refrigerant conduit; selectively operating by means of the controller, the compressor valve and the condenser outlet valve between first and second positions in response to at least one of a temperature, pressure or mass flow reading from the mass flow sensor, whereby said compressor valve directs a flow of the refrigerant through the first reclaim coil conduit when in the first position, said compressor valve directs a flow of the refrigerant through the refrigerant conduit to the condenser when said compressor valve is in the second position, and whereby said condenser outlet valve directs a flow of the refrigerant through the refrigerant conduit from the compressor to the expansion valve when said condenser outlet valve is in the first position, said condenser outlet valve directs a flow of the refrigerant through the second reclaim coil conduit when said condenser outlet valve is in the second position.

According to another aspect, there is provided, a method of dual heat reclamation from a refrigeration system comprising the following steps: providing a condenser, an expansion valve; an evaporator and a compressor; providing a refrigerant conduit defining a cyclic flow path for a refrigerant from the condenser to the expansion valve to the evaporator to the compressor and back to the condenser; providing a compressor valve located in the refrigerant conduit at a position between the compressor and the condenser; providing a condenser outlet valve located in the refrigerant conduit at a position between the condenser and the expansion valve; providing a reclaim coil being a condenser located in a heating, ventilation, and air conditioning (HVAC) unit, the reclaim coil being located adjacent to a cooling coil for cooling and dehumidifying an air stream passing over said cooling coil; providing a first reclaim coil conduit defining a flow path for the refrigerant from the compressor valve through the reclaim coil and then to the refrigerant conduit at a position between the compressor valve and the condenser whereby the refrigerant flows from the first reclaim coil conduit into the refrigerant conduit and then to the condenser through the refrigerant conduit; providing a second reclaim coil conduit defining a flow path for the refrigerant from the condenser outlet valve through the reclaim coil to the refrigerant conduit at a position between the condenser outlet valve and the expansion valve whereby the refrigerant flows from the second reclaim coil conduit into the refrigerant conduit and then to the expansion valve through the refrigerant conduit; providing at least one of a refrigerant temperature sensor located in the refrigerant conduit at the exit of the condenser outlet valve for measuring a temperature of the refrigerant in the refrigerant conduit at the exit of the condenser outlet valve and an ambient air temperature sensor located outside of a space in which the refrigeration system is located for measuring an ambient outdoor temperature; providing a controller operatively connected to refrigerant temperature sensor and ambient air temperature sensor for receiving data from said sensors, the controller being operatively connected to the condenser outlet valve and to the compressor valve; circulating a refrigerant having a critical temperature of less than 95° F. through the refrigerant conduit; determining by means of the controller that the refrigeration system would benefit from subcooling in response to data received from the refrigerant temperature sensor that the refrigerant is in a phase of a supercritical fluid having both a liquid and gas component and/or in response to data from the ambient air sensor and the refrigerant temperature sensor that the temperature difference between the ambient air and the refrigerant is such that the refrigerant is in a phase of a supercritical fluid having both a liquid and gas component; operating the (HVAC) unit in dehumidification mode; selectively operating by means of the controller, the compressor valve and the condenser outlet valve between first and second positions in response data received from the sensors, whereby said compressor valve directs a flow of the refrigerant through the first reclaim coil conduit when in the first position, said compressor valve directs a flow of the refrigerant through the refrigerant conduit to the condenser when said compressor valve is in the second position, and whereby said condenser outlet valve directs a flow of the refrigerant through the refrigerant conduit from the compressor to the expansion valve when said condenser outlet valve is in the first position, said condenser outlet valve directs a flow of the refrigerant through the second reclaim coil conduit when said condenser outlet valve is in the second position, said selective operation being made to operate the refrigeration system in subcooling mode with the compressor valve and the condenser outlet valve being in the second positions when the HVAC unit is operating in dehumidification mode and at least one of the sensors indicate that the phase of the refrigerant is in a phase of a supercritical fluid thereby indicating that the refrigeration system can operate efficiently in the subcooling mode.

BRIEF DESCRIPTION OF THE DRAWINGS

The drawings illustrate several embodiments of the present disclosure, wherein identical reference numerals refer to identical or similar elements or features in different views or embodiments shown in the drawings.

DETAILED DESCRIPTION

Transcritical booster refrigeration system 20 makes use of a refrigerant that has a critical temperature that is low enough to allow transcritical operation in normal ambient temperatures of about 65° F. to about 95° F. Preferably the refrigerant has a critical temperature of less than 95° F. Most preferably the refrigerant is carbon dioxide (R-744) having a critical temperature of 87.8° F.

Figure 1:
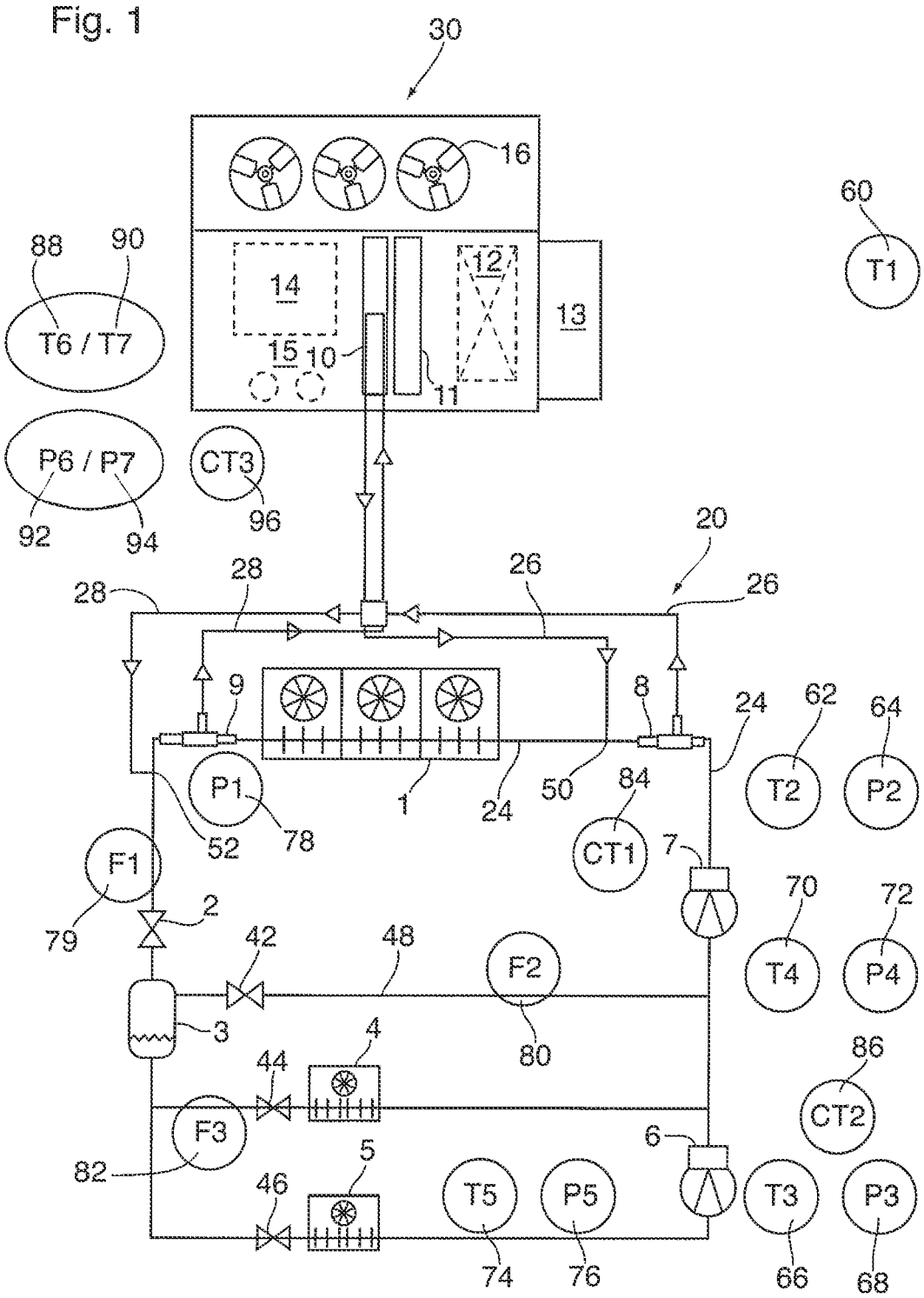
FIG. 1 is a schematic diagram of a transcritical refrigeration system in fluid communication with an HVAC unit having a dual reclaim coil.

With reference to FIG. 1, the transcritical booster refrigeration system 20 includes a condenser 1. The condenser 1 is also referred to as a gas cooler. The system includes an expansion valve 2, and an evaporator 4 which is preferably a medium temperature evaporator. The system 20 preferably also includes a low temperature evaporator 5. The system 20 includes compressor 7. Preferably the compressor 7 is a high-pressure compressor. Preferably, the system 20 additionally includes a low stage compressor 6.

A refrigerant conduit 24 defines a cyclic flow path for the refrigerant from the condenser 1 to the expansion valve 2 to the evaporators 4, 5 to the compressors 6, 7 and back to the condenser 1. Preferably, a flash tank 3 that functions as a liquid/vapor separator is located between the expansion valve 2 and the evaporators 4, 5.

A compressor valve 8 is located in the refrigerant conduit 24 at a position between the compressor 7 and the condenser 1. A condenser outlet valve 9 is located in the refrigerant conduit 24 at a position between condenser 1 and the expansion valve 2.

The transcritical booster refrigeration system 20 is operatively connected to a reclaim coil 10. The reclaim coil is preferably a smaller condenser located in a heating, ventilation, and air conditioning (HVAC) unit 30, as shown in FIG. 1.

The transcritical booster refrigeration system 20 includes a first reclaim coil conduit 26 that defines a flow path for the refrigerant from the compressor valve 8 through the reclaim coil 10 and then to the refrigerant conduit 24 at a position 50 between the compressor valve 8 and the condenser 1 whereby the refrigerant flows from the first reclaim coil conduit 26 into the refrigerant conduit 24 and then to the condenser 1 through the refrigerant conduit 24.

A second reclaim coil conduit 28 defines a flow path for the refrigerant from the condenser outlet valve 9 through the reclaim coil 10 to the refrigerant conduit 24 at a position 52 between the condenser outlet valve 9 and the expansion valve 2 whereby the refrigerant flows from the second reclaim coil conduit 28 into the refrigerant conduit 24 and then to the expansion valve 2 through the refrigerant conduit 24.

The booster system 20 preferably includes a number of sensors that are operatively connected to a controller. An example of a controller that that could be employed is a controller similar to the Emerson Lumity E3 controller for $CO_2$ refrigerant applications The controller is operatively connected to the compressor valve 8 and the condenser outlet valve 9 for selectively operating the compressor valve 8 and the condenser outlet valve 9 between first and second positions in response to readings from a sensor or from multiple sensors. For example, sensors are preferably included for measuring the temperature, pressure and mass flow of flash gas exiting the condenser outlet valve 9. A sensor may also be located in the refrigerant conduit 24 at the exit of the condenser outlet valve 9 for measuring the temperature of the refrigerant in order to determine the phase of the refrigerant. In addition, a sensor is preferably located outside of the space for measuring the temperature of the ambient air in order to determine a temperature difference ($\Delta T$) between the ambient temperature and the temperature of the refrigerant at the exit of the condenser outlet valve 9.

FIG. 1 shows the preferable inclusion and location of sensors in the booster system 20 and the HVAC system 30 coupled to the booster system 20. All sensors are operatively connected to the controller for operating the compressor valve 8 and the condenser outlet valve 9 between the first and the second positions. Outdoor air-dry bulb temperature sensor 60 is preferably located outside of the space containing the booster system 20. A temperature sensor 62 is preferably located in the refrigerant conduit 24 between the high-pressure compressor 7 and the compressor valve 8. In addition, a pressure sensor 64 is preferably located in the refrigerant conduit 24 between the high-pressure compressor 7 and the compressor valve 8. A temperature sensor 66 is preferably located in the refrigerant conduit 24 at the exit of the low stage compressor 6. In addition, a pressure sensor 68 is preferably located in the refrigerant conduit 24 at the outlet of the low stage compressor 6. A temperature sensor 70 is preferably located in the refrigerant conduit 24 between the low stage compressor 6 and the high-pressure compressor 7. In addition, a pressure sensor 72 is preferably located in the refrigerant conduit 24 between the low stage compressor 6 and the high-pressure compressor 7. A temperature sensor 74 is preferably located in the refrigerant conduit 24 between the low temperature evaporator 5 and the low stage compressor 6. In addition, a pressure sensor 76 is preferably located in the refrigerant conduit 24 between the low temperature evaporator 5 and the low stage compressor 6. A pressure sensor 78 is preferably located in the refrigerant conduit 24 at the outlet of the condenser outlet valve 9. A total refrigerant flow meter 79 is preferably located in the refrigerant conduit 24 between the condenser outlet valve 9 and the expansion valve 2. A flash gas flow sensor 80 is located in a flash gas bypass line 48 of the refrigeration conduit 24 between the flash tank separator 3 and the compressor 7. A liquid flow sensor 82 is preferably located in the refrigeration conduit 24 between the flash tank separator 3 and the evaporators 4, 5.

The booster system may optionally include a power sensor 84 located at the outlet of the high-pressure compressor 7 and a power sensor 86 located at the outlet of the low stage compressor 6.

The HVAC system 30 preferably includes an HVAC discharge temperature sensor 88 located in a HVAC discharge line of the HVAC system and a HVAC suction temperature sensor 90 located in a HVAC suction line of the HVAC system. In addition, the HVAC system 30 preferably includes an HVAC discharge pressure sensor 92 located in a HVAC discharge line of the HVAC system and a HVAC suction pressure sensor 94 located in a HVAC suction line of the HVAC system. A HVAC power sensor 96 may optionally be included and located at the HVAC compressors.

The compressor valve 8 directs a flow of the refrigerant through the first reclaim coil conduit 26 when in the first position. The compressor valve 8 directs the flow of the refrigerant through the refrigerant conduit 24 to the condenser 1 when said compressor valve is in the second position. The condenser outlet valve 9 directs the flow of the refrigerant through the refrigerant conduit 24 from the compressor to the expansion valve when said condenser outlet valve is in the first position. The condenser outlet valve 9 directs a flow of the refrigerant through the second reclaim coil conduit 28 when said condenser outlet valve 9 is in the second position.

There are a number of options for determining whether the system 20 will operate with an efficiency (COP) low enough to require subcooling from the dual reclaim system where the compressor valve 8 is operated to be in the second position and the condenser outlet valve 9 is operated to be in the second position.

In order to recuperate heat from the outlet of the condenser 1 near the condenser outlet valve 9, the refrigerant in the refrigerant conduit 24 at the condenser outlet valve 9 has to be a supercritical fluid or in a mixture of gas and liquid form. If the refrigerant leaving the condenser 1 is fully liquid then the refrigeration system is in subcritical mode and the reclaim coil can barely recover any heat, and the subcooling effect and the subsequent efficiency increase on the refrigeration cycle will not be as significant.

A first option for determining whether the system 20 can significantly benefit from subcooling is to determine the mass flow of the flash gas being sent back to the compressors by the flash tank/separator 3. This can be determined from measurements based on data received from the flash gas flow sensor 80. When the supercritical fluid or liquid/gas mixture leaves the condenser/gas cooler 1, only the liquid portion of the mixture is usable by the low temperature and medium temperature evaporators and the gas portion must be separated and sent back to the compressors through the flash gas bypass line 48 to go through the compression and cooling process again. The ratio (mass flow) of flash gas compared to the total mass flow of the fluid leaving the gas cooler 1 is a strong indicator of the inefficiency in the system due to a lack of full condensation in the gas cooler. The flash gas flow sensor 80 measures the mass flow in order to determine the mass flow of refrigerant being sent back to the compressors 6, 7. The ratio of the flash gas mass flow to the total mass flow of the refrigerant can be used as a parameter to determine if and how the system will benefit from subcooling (e.g. if the flash gas mass flow >15% of the total mass flow then the subcooling is beneficial). The threshold percentage could vary based on the system size and other characteristics.

By knowing the pressure and temperature of the refrigerant such as R-744, the phase of the refrigerant could be accurately located on a phase diagram for the specific refrigerant being employed.

Another option for determining whether the system 20 requires subcooling is to determine the phase of the refrigerant leaving the condenser 1 based on the temperature of the refrigerant. If the temperature is above a set point dictated by the controller, then the dual reclaim inlet will be the exit of the gas cooler. The set point must be determined based on each booster system's characteristics and specifications.

The temperature sensors 62, 66, 70, 74 located in the refrigerant conduit each provide data for determining the state of refrigerant entering the reclaim coil through the second reclaim coil conduit 28.

A further option is to determine the booster system's need for subcooling based on ambient temperature. If the temperature and pressure readings of the refrigerant leaving the condenser 1, or the temperature, pressure and mass flow readings of the flash gas are not available, the ambient temperature could be used to determine the phase of the leaving refrigerant. Similar to any other condensing unit, gas coolers maintain a temperature difference between the ambient temperature and the operating fluid, while the $\Delta T$ of the HFC system condensers are usually about 10-15° F., the $CO_2$ gas coolers, have a lower $\Delta T$ of about 5-10° F. The condensing unit's temperature difference is usually provided by the manufacturer for the summer design condition. Therefore, knowing the base $\Delta T$ and the ambient temperature, and the critical temperature of the refrigerant, the phase of the fluid could be determined, and the mode of operation can be selected accordingly by the controller.

The transcritical booster refrigeration system 20 is divided into two stages: low and high pressure. In operation, the refrigerant cycles through the refrigerant conduit 24, leaving the condenser 1 and entering the high-pressure expansion (throttling) valve 2. The refrigerant then leaves the expansion valve 2 at a lower pressure. Here a mixture of liquid and gas is preferably piped into the flash tank 3 that works as a liquid/vapor separator. From the bottom of the flash tank 3, liquid refrigerant is fed through expansion valves 44, 46 to the medium temperature evaporator 4 and the low temperature evaporator 5. The refrigerant leaving the low temperature evaporator 5 is fully evaporated and returned to the low stage compressor 6 as a vapor. The low-pressure compressor 6 discharges into the inlet of the high pressure compressor 7. Vapor from medium temperature evaporator 4 goes directly to the inlet of the high pressure compressor 7. A third refrigerant stream known as flash gas is also piped directly from the top of the flash tank 3 through a flash gas bypass valve 42 to the suction side of the high pressure compressor 7. These compress the low-pressure compressor's discharge, medium temperature vapor, and flash gas to a high pressure in order to reject the heat from the system to the ambient environment in the condenser 1. Depending on ambient conditions, the system can operate either subcritically or transcritically. In subcritical mode, the condensing temperature is always below the critical point and the gas cooler 1 acts as a condenser. The leaving refrigerant is in liquid state. In transcritical mode, the gas cooler cannot fully act as a condenser. The leaving refrigerant is a supercritical fluid that cannot be called liquid or vapor. This happens when the temperature/pressure of the fluid is above the critical point, or a mixture of gas and liquid $CO_2$.

As described above, the flash tank 3 works as a separator that bypasses the gas portion of the mixture to the high-pressure compressor 7 and sends the liquid portion to the low and medium temperature evaporators 5, 4 to provide cooling for refrigeration cases. Hence, higher ambient temperatures resulting in transcritical operation of the gas cooler 1 will reduce the amount of the liquid portion, and subsequently the net refrigeration effect (NRE) in the evaporators decreases, causing loss of overall efficiency. For this reason, the transcritical system is less suitable for hot ambient climates unless extra cooling measures are taken during or after the gas cooler operation.

The refrigeration system's efficiency is increased by subcooling the refrigerant leaving the gas cooler 1 using dual heat reclaim. The reclaim coil 10, preferably located in the HVAC unit 30, provides a heat sink that is at a lower temperature than the ambient air. Typical heat reclaim coils receive inlet refrigerant from the high-pressure compressor's discharge where the refrigerant's pressure and temperature are high, and the amount of available heat is at its maximum. Typically, when the system is operating above the critical point there is almost no need for heating in the space and the large amount of heat generated during the compression process will be wasted, even if the discharge line is piped into a reclaim coil. For this reason, in areas where the booster system 20 operates above the critical point for a considerable part of the year, the energy savings from a reclaim coil cannot justify the cost of installation. However, with a dual reclaim coil that intelligently switches the inlet point between the high-pressure compressor discharge to the gas cooler outlet when the ambient temperature is high, heat will be taken from the gas cooler outlet. This will satisfy the need for reheating the dehumidification air stream in a HVAC system responsible for bringing outside air to a supermarket, for example, which usually operates at a low suction temperature, to dehumidify the outside air below the space dew point setpoint. This increases the efficiency of the refrigeration system by subcooling the refrigerant before being sent to the expansion valve 2 and the flash tank/separator 3. The extra savings for the refrigeration system could be high enough to justify the installation cost and reduce the return on investment time significantly.

Such dual reclamation strategy is not feasible with common hydrofluorocarbon (HFC) refrigeration systems. For HFCs, the critical temperature is much higher, and the ambient temperature cannot be higher than the critical temperature and the outlet of the condenser is liquid refrigerant, therefore such a dual reclamation system is exclusive to a transcritical R-744 booster system or other refrigerants with similar thermodynamic properties that may have vapor leaving the condensing unit under normal ambient conditions.

A dehumidification unit with mechanical ventilation can benefit from the dual reclaim strategy. The majority of humidity (latent load) in a supermarket comes from the outside air (mechanical ventilation needed for indoor air quality and pressurization), typically the HVAC unit bringing fresh air to the sales floor is responsible for dehumidification and maintaining the space moisture level at desired conditions. Such units could be a DOAS (dedicated outdoor air system) or a rooftop unit (RTU) with both outside air and return air programmed to control both temperature and humidity. As shown in FIG. 1, the outside air enters the unit through a damper 13 and mixes with the return air stream from the space 12 before passing through a DX coil 11 and releasing heat to the refrigerant (e.g., R410-A). The refrigerant will be compressed by the HVAC compressors 14, and the heat captured from the air mixture will be released to the ambient air at the HVAC's condensing unit 16.

A dehumidification HVAC unit's compressor suction pressure is typically lower than that of a standard RTU's due to the low evaporating temperature that is required for dehumidifying the entering air below the space dewpoint at the DX coil. Therefore, the air leaving the coil at or near saturation is typically colder than the space setpoint temperature. If a supply fan 15 keeps providing air at the low off-coil temperature to the space, the space temperature drops below the human comfort range and the HVAC system has to heat the space simultaneously to prevent overcooling caused by dehumidification. In order to avoid using the primary heating source of the HVAC unit (e.g. natural gas) the HVAC manufacturers usually install a "reheat coil" right after the DX coil to increase the temperature of the cold and saturated off-coil air before being supplied to the space. The reheat coil could use the HVAC system's internal refrigeration cycle's hot gas, or, if available, use the discharged hot gas from the supermarket's refrigeration system's compressors. Compared to the HVAC system's reheat coil, the refrigeration system typically provides a larger amount of heat and is called a "heat reclaim coil". The advantage of using a reclaim coil is that the system can continue recovering wasted heat from the refrigeration system, not only for summer dehumidification reheating but also for winter space heating purposes. As mentioned above, this traditional method of heat reclamation is very effective in cold climates and has been used for decades. In most hot and humid climates, the infrequent need for space heating results in supermarket owners using cheaper, built-in internal reheat coils. A dual reclaim system intelligently switches its inlet between the refrigeration system's hot gas discharge (which is suitable for winter space heating), and the gas cooler outlet (which is suitable for summer dehumidification reheating). It also increases the refrigeration system's efficiency and shifts the cost-benefit equilibrium in hot and humid regions in favor of using the heat reclaim system. Such a dual reclaim system not only results in energy and cost savings, but also makes the overall operation more environmentally friendly by releasing less heat to the atmosphere.

Figure 2:
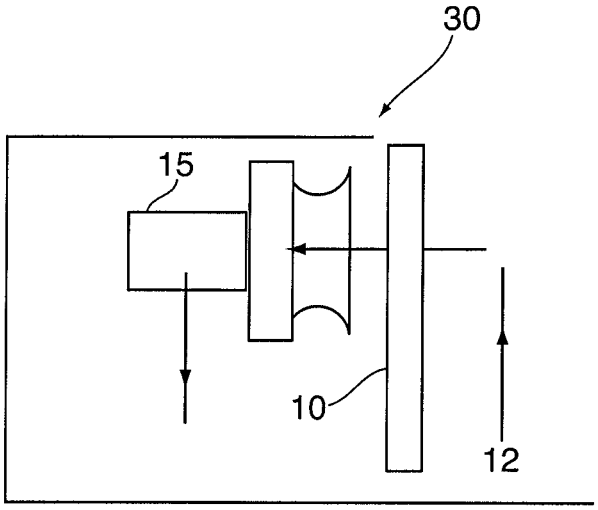
FIG. 2 is a schematic diagram of a recirculating unit with a reclaim coil.

FIG. 2 is a schematic view of a recirculating unit with dual reclaim coil. Return air from the space 12 comes to the HVAC unit 30 and passes through the reclaim coil 10 and exchanges heat with the hot refrigerant coming from the refrigeration system 20 and leaves the reclaim coil 10 at a higher temperature to be supplied to the space by a supply fan 15.

Active and Passive Subcooling Reclamation

Active subcooling reclamation is only for a refrigeration system coupled to a reclaim coil as a part of a dehumidification HVAC unit. When the refrigeration system can significantly benefit from subcooling (determined by one of the methods explained above) and the HVAC unit is in active dehumidification, the temperature difference between the gas cooler's outlet refrigerant at the position of the condenser outlet valve 9, and the DX coil 11 leaving air is high enough to generate the heat for dehumidification reheat and to subcool the refrigerant by a few degrees. This increases the efficiency of the refrigeration system. Depending on the airflow and the temperature of the DX coil leaving air, the process might end up in full or partial condensation of the supercritical fluid or vapor/liquid mixture to liquid, which further reduces the amount of flash gas bypass in the flash tank/separator 3 and increases the net refrigeration effect (NRE) of the refrigeration system in low temperature 4 and medium temperature 5 evaporators.

Passive subcooling reclamation is employed when the refrigeration system can significantly benefit from subcooling. This can occur for example when the ambient conditions are not humid enough to initiate dehumidification in the HVAC unit. Under these conditions, the reclaim coil 10 continues the circulation of the refrigerant taken from the gas cooler's outlet near the condenser outlet valve 9, while the mixed or return air temperature is not as low as in active dehumidification mode, it is still lower than ambient temperature after mixing with the space return air 12 and still provides some subcooling effect for the refrigeration system. In presence of open refrigeration cases in a supermarket environment, typically the space temperature is lower than the setpoint in a supermarket's refrigeration zone and the passive reclamation will increase the space temperature to a more comfortable level while providing partial subcooling for the transcritical system. The passive subcooling mode continues as long as the process provides comfort for the space.

Figure 3:
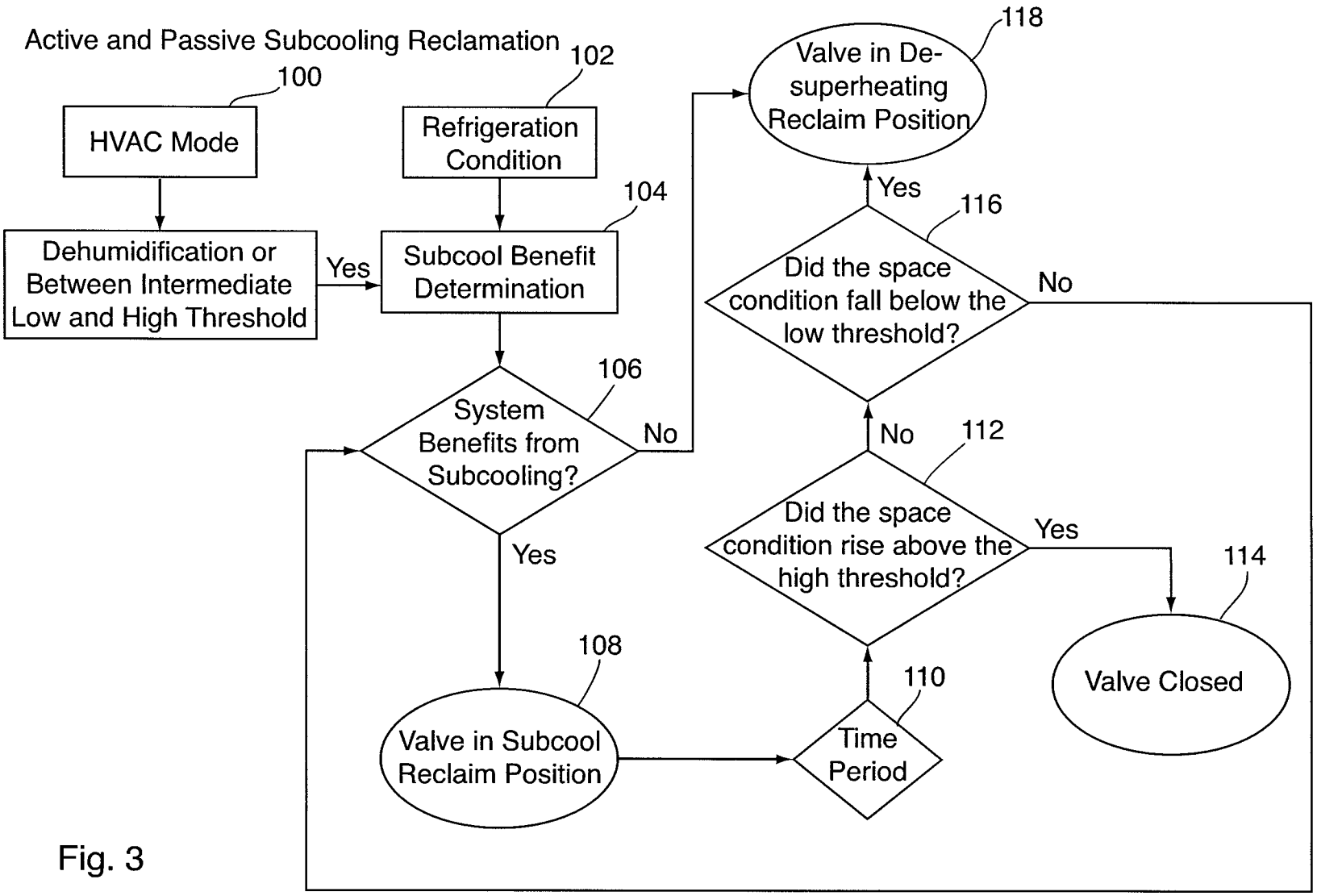
FIG. 3 is a flow diagram of a control process of active and passive subcooling reclamation.

A decision chart for the active and passive subcooling/reclamation modes is illustrated in FIG. 3. With reference to FIG. 3, a first determination is made regarding a HVAC mode 100. Active reclamation requires that the HVAC system be in dehumidification mode. For passive reclamation, a space temperature range must be between low and high threshold, as defined below with reference to FIG. 6. A next assessment is made with respect to refrigeration condition 102. For active or passive reclamation to provide an energy efficiency benefit, a determination has to be made that the system can benefit from subcooling according to measurements made from data received from the sensors according to one of the criteria described above. If the HVAC mode 100 and refrigeration condition criteria 102 are met, and an affirmative or yes answer is obtained for subcool benefit 104 resulting in an affirmative answer to the question of whether the system benefits from subcooling 106. The system then operates in subcooling mode 108 with the compressor valve 8 and the condenser outlet valve 9 being in the second position. After a period of time 110, preferably between 30 minutes and 1 hour, an evaluation is made as to whether space condition has risen above the high threshold 112. If the answer is in the affirmative, then step 114 is implemented and the compressor valve 8 and the condenser outlet valve 9 are closed and reheat is terminated. If the answer at step 112 is in the negative, then step 116 is initiated which is a determination of whether the space condition has fallen below the low temperature threshold, as defined below with reference to FIG. 6. If the answer is yes, the system switches to de-superheating reclaim mode 118 with the compressor valve 8 and the condenser outlet valve 9 being placed in the first position. If the step 116 determination is negative, then the decision mechanism requires a return to step 106 for an assessment as to whether the system still benefits from subcooling. If the answer to step 106 is negative, then step 118 is followed.

Artificial Subcooling—Reclamation

When the refrigeration system can significantly benefit from subcooling, but the HVAC system is not in active dehumidification and the space temperature is near or above the cooling set point (so that no more heat can be discharged to the space), an optimization process is needed to determine if and how artificial running of the HVAC compressor would increase the overall (combined) efficiency of the two systems.

In artificial subcooling mode, the two components exchange heat through the reclaim coil, while the refrigeration system's efficiency will increase due to rejecting extra heat after the gas cooler and its energy consumption will reduce. The HVAC system will initiate (or increase) the compressor capacity, thus the energy consumption of the HVAC system will increase. The purpose of optimization in artificial cooling is to find out if initiating and continuing the artificial subcooling will increase the overall (HVAC+refrigeration) system efficiency.

In a $CO_2$ booster system, the mass flow of the flash gas is a strong indicator to verify and quantify inefficiency. The supercritical fluid or the vapor/liquid mixture at the exit of the gas cooler will be separated into gas and liquid parts, the liquid part which is the usable fluid to create the net refrigeration effect, will be sent to the evaporators, and the gas part (flash gas) will go back to the compressors. The purpose of the subcooling is to increase the liquid portion of the gas cooler's leaving fluid and reduce the flash gas mass flow.

Optimization Process:

The refrigerant mass flow transferred back to the compressors in the form of flash gas, will be compressed to higher pressure/temperature, this will increase the compressor work rate, without increasing the net refrigeration effect, therefor the COP (coefficient of performance) of the refrigeration system will decrease.

(1)

$$COP = \frac{Qc}{W}$$

Where Qc=useful heat (removed from the cases in evaporators)

W=work input to the system (in compressors)

The flash gas increases the work rate (W) without increasing the useful cooling effect.

The amount of heat transferred between two points in a fluid stream can be calculated from the mass flow and the enthalpy difference between the two points:

$$Q^\circ = m^\circ \Delta h \quad (2)$$

Where:

$Q^\circ$=Heat transfer intensity between the two points $\Delta h$=Enthalpy difference between the two points $m^\circ$=mass flow of the fluid The total mass flow of the system must be measured at some point between the medium temperature compressor 7 outlet and the flash tank/separator 3 inlet, the total mass flow ($m^\circ t$) of the system will be separated to flash gas mass flow ($m^\circ g$) which will be bypassed and redirected to the medium temperature compressors and liquid mass flow ($m^\circ l$) which will be sent to the evaporators.

$$m^\circ_{t=m^\circ_g+m^\circ_l} \quad (3)$$

Therefore:

$$m^\circ_{l=m^\circ_t-m^\circ_g} \quad (4)$$

An additional mass flow measurement can determine the mass flow of the low temperature evaporator 5 and medium temperature evaporator 4.

$$m^{\circ}_{L}=m^{\circ}_{MT}+m^{\circ}_{LT} \tag{5}$$

Figure 7:
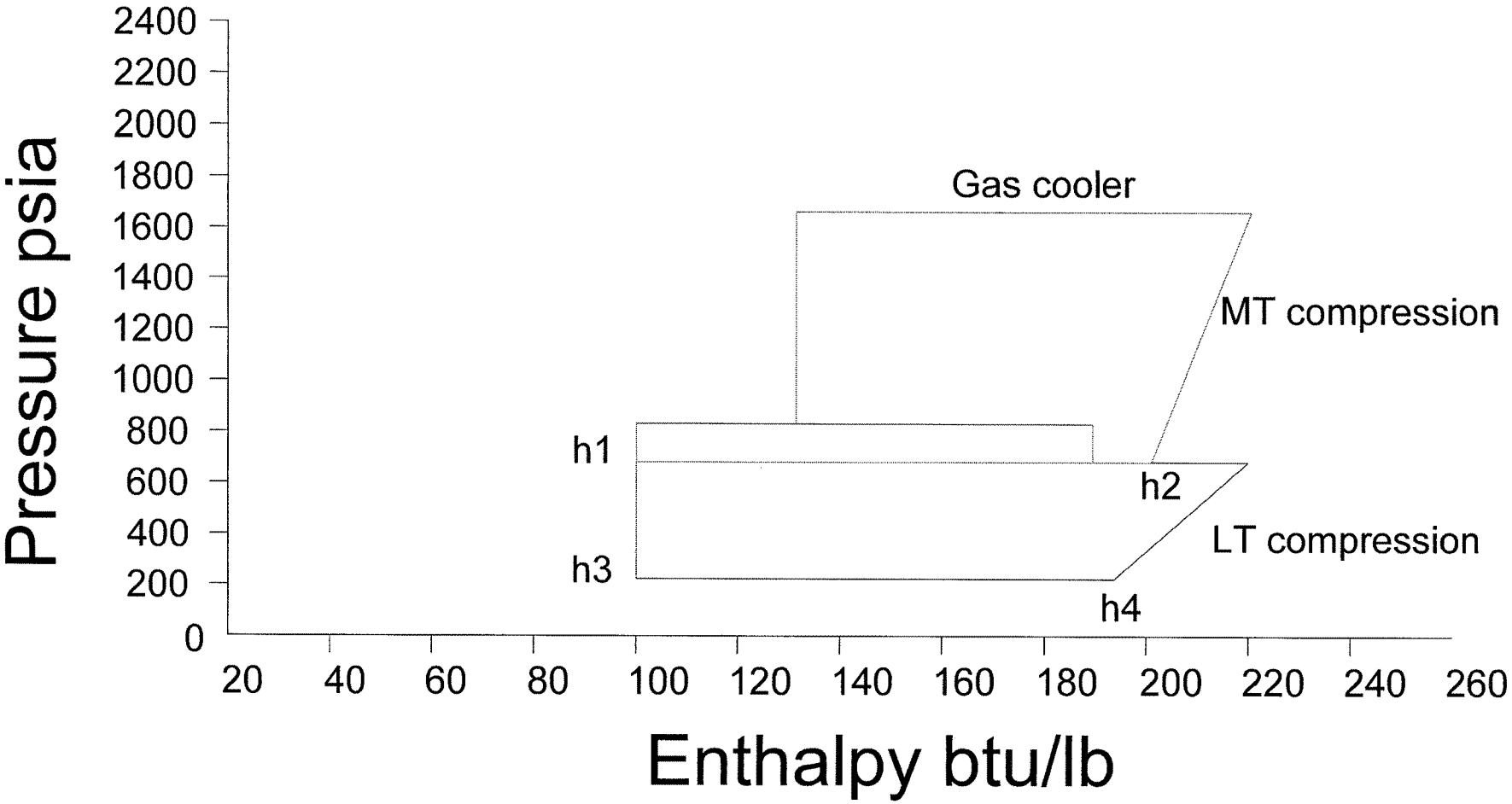
FIG. 7 is a graph showing a plot of pressure v. enthalpy.

Booster systems usually have suction pressure and temperature sensors for each of the medium temperature (MT) and low temperature (LT) circuits. The enthalpy of the saturated liquid entering the MT evaporator (h1) and the enthalpy of the saturated vapor leaving the MT evaporator (h2) can be read from the refrigerant ($CO_2$) saturation properties. As shown in FIG. 7, the entering (h3) and leaving (h4) enthalpy of the low temperature evaporator can be obtained similarly.

The net cooling capacity of medium temperature and low temperature circuits can be calculated:

$$Q_{cm}=m^{\circ}_{MT}\times(h_2-h_1) \tag{6}$$

$$Q_{cl}=m^{\circ}_{LT}\times(h_4-h_4) \tag{7}$$

If a separate mass flow reading for the low temperature (or medium temperature) evaporators is not available, the liquid mass flow of both MT and LT evaporators (equations 5) can be used to estimate the total capacity. In a booster system, the inlet enthalpy of the LT and MT circuits are identical as they share the same expansion device (2).

(h1=h3 in FIG. 7).

The leaving enthalpy of the two circuits (h2 and h4) can be slightly different but will be close to each other. It is important to note that the purpose of the calculation of capacity and COP before and after the artificial subcooling is to determine the difference between the COPs and calculate the savings. If the baseline and alternative COPs are calculated based on the same assumptions for Δh, the relative COP and the net energy difference can still be valid. Therefore, although having the third mass flow measurement is the preferred option, with only two mass flow measurements, the optimization method is still valid.

The total capacity of the evaporators can be calculated:

If the mass flow of the LT and MT are known individually:

$$Q_c=Q_{cm}+Q_{cl} \tag{8}$$

If the only the total liquid mass flow is known:

$$Q_c=m^{\circ}_{L}\times(h_2-h_1) \tag{9}$$

The compressor input power before subcooling (W1) can be either calculated from the performance curve or coefficients (provided by the manufacturer) or directly from a power meter (CT) if available.

If performance curve or coefficients are available, then the power value can be derived from the discharge and suction temperature sensor readings for LT and MT compressors.

The COP of the system before subcooling:

(10)

$$COP_1=\frac{Qc}{W_1}$$

When the artificial subcooling process begins (initiating or increasing the capacity of the HVAC compressors for the sole purpose of subcooling), the mass flow at the exit of the gas cooler, the flash gas mass flow and the MT and LT evaporators' liquid mass flow will change subsequently. When subcooling is applied, the temperature of the refrigerant at the outlet of the gas cooler will decrease, the liquid portion of the fluid will increase, and the mass flow of the flash gas after subcooling will be less than the flash gas mass flow before applying the subcooling:

Flash gas mass flow after subcooling will be less than flash gas mass flow before subcooling:

$$m^{\circ}_{gas-s}<m^{\circ}_{gas} \tag{11}$$

If individual mass flow readings are available for LT and MT circuits. The capacity calculation after the subcooling is like the baseline capacity calculations:

(12) Cooling capacity of the medium temperature circuit after subcooling:

$$Q_{cms}=m^{\circ}_{MTs}\times(h_{2s}-h_{1s})$$

(13) Cooling capacity of the low temperature circuit after subcooling:

$$Q_{cls}=m^{\circ}_{LTs}\times(h_{4s}-h_{3s})$$

(14) Total cooling capacity after subcooling:

$$Q_{cs}=Q_{cms}+Q_{cls}$$

If individual mass flow readings are not available and only total mass flow and flash gas mass flow are known, the difference between flash gas mass flow before and after the subcooling can be used to determine the increased capacity due to subcooling. In a typical booster system, the low temperature mass flow will not be affected by the amount of flash gas and the change in flash gas mass flow will impact the medium temperature circuit. Therefore, the added capacity due to subcooling can be calculated:

$$Q_{cs}=(m^{\circ}_{gas}-m^{\circ}_{gas-s})\times(h_{2s}-h_{1s})+Q_c \tag{15}$$

The COP of the system after subcooling:

(16)

$$COP_s=\frac{Qcs}{W_s}$$

Having the COP of the system before and after subcooling allows the controller to calculate the energy saving due to the subcooling, adjusted for the evaporator load.

When the artificial subcooling initiates, the HVAC compressors will energize for the sole purpose of creating low temperature at the air side of the reclaim coil to enable subcooling and negate the heat recovered from subcooling and prevent the space temperature from rising above the comfort level. Therefore, the energy consumption of the HVAC compressors at this mode, should be considered as a penalty. The optimization process must determine if the energy saving of the refrigeration system overweighs the energy penalty of the HVAC system. The HVAC compressors work with much higher suctions temperature/pressure compared to the refrigeration system and the COP of the HVAC compressors are usually higher than the refrigeration compressors at all conditions, but the overall amount of energy saving/penalty of the two systems depends on other factors such as the size of each system, the ΔT between the air and the refrigerant at the reclaim coil, the outside air temperature, the gas cooler/condenser ΔT etc.

Therefore, constant monitoring of the system efficiency and comparison against the baseline efficiency is needed to determine if the continuation of artificial subcooling is beneficial for the entire system.

The HVAC compressor energy can also be measured from the performance curve (or coefficient) and the suction and discharge temperatures (if available) or reading from power meter (CT) if available.

When subcooling is in place, the energy consumption without subcooling (W-hypothetical) can be calculated from the active evaporator capacity and the baseline COP without subcooling, $COP_1$ $$W_h = \frac{Qcs}{COP_1} \tag{17}$$

Now the energy saving of the refrigeration system due to subcooling can be calculated:

$$Rsaving = Wh - Ws \tag{18}$$

If the HVAC system only has one fixed (on/off) compressor, then the optimization process involves monitoring the power and load and calculating the $COP_1$ before subcooling for a period, then applying the subcooling and calculating the $COP_s$ for an identical period.

The HVAC compressor power ($W_{hvac}$) is the energy penalty.

The artificial subcooling continues until:

$$Rsaving > W_{hvac}$$

The artificial subcooling stops if:

$$Rsaving < W_{hvac}$$

If the HVAC compressor has variable capacity (digital scroll, variable speed compressor, or multiple circuits) then the above method can be used to increase the artificial subcooling capacity incrementally and find the optimum capacity of the HVAC compressor.

The subcooling begins at a low capacity (e.g., 10% of the HVAC compressors), $COP_1$, $COP_s$, Rsaving and $W_{hvac}$ will be calculated if:

$$Rsaving > W_{hvac}$$

The HVAC compressor capacity will increase by another increment and the savings will be evaluated against the previous stage. If:

$Rsaving_2 > W_{hvac2}$, the HVAC compressor capacity will increase by another increment. This continues until the HVAC compressor capacity reaches 100% or further increase is not justified.

The artificial subcooling stops (fixed compressor) or goes back to lower stage incrementally (variable compressor), if $$Rsaving < W_{hvac}$$

The artificial subcooling will stop (regardless of the staging and compressor type) if:

The space temperature rises above the comfort threshold.

The indoor or outdoor conditions change to other modes of operation such as active and passive subcooling or de-superheating.

Passive and active subcooling always are prioritized over artificial subcooling because there is no energy penalty involved in those modes and the energy reduction on the refrigeration system will be net saving.

Figure 4:
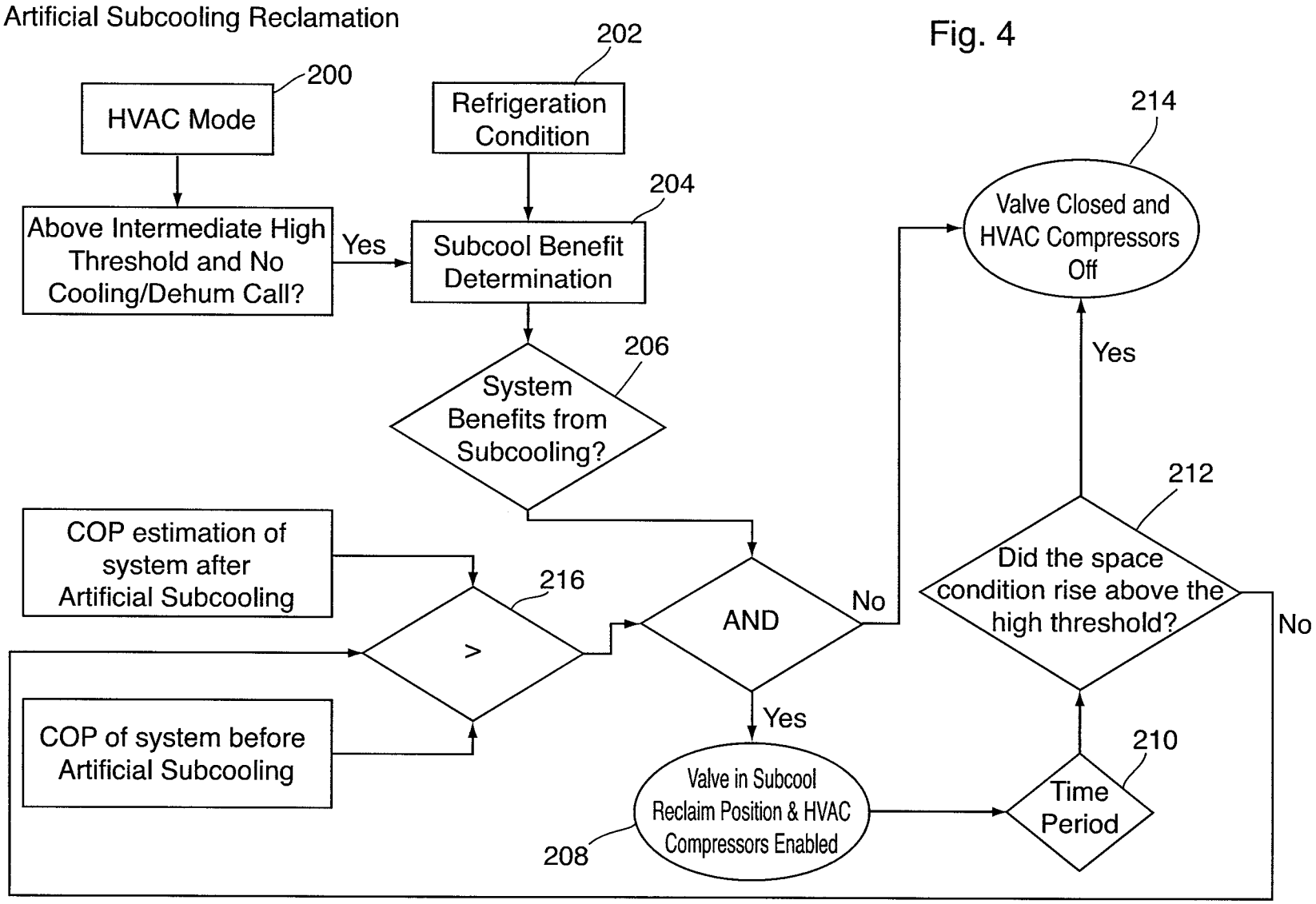
FIG. 4 is a flow diagram of a control process of artificial subcooling reclamation.

A decision chart for artificial subcooling/reclamation is illustrated in FIG. 4. With reference to FIG. 4, a first determination is made regarding a HVAC mode 200. For artificial reclamation, a space temperature range must be above intermediate high threshold, as defined below with reference to FIG. 6. In addition, the HVAC system is not in dehumidification mode. The next assessment is made with respect to refrigeration condition 202. A determination has to be made that the system can benefit from subcooling according to measurements made from data received from the sensors according to one of the criteria described above. If the HVAC mode 200 and refrigeration condition criteria 202 are met, an affirmative or yes answer is obtained for subcool benefit 204 resulting in an affirmative answer to the question of whether the system benefits from subcooling 206. When it is determined that the system benefits from subcooling, the decision chart then moves to step 208 where the compressor valve 8 and the condenser outlet valve 9 are moved to the second position for subcooling. In addition, the HVAC compressors are enabled. After a period of time 210, preferably about 30 minutes to 1 hour, an evaluation is made as to whether the space condition has risen above the high threshold 212. If the answer is in the affirmative, then step 214 is implemented and the compressor valve 8 and the condenser outlet valve 9 are closed, and reheat is terminated. In addition, the HVAC compressors are turned off. If the answer at step 212 is in the negative, then step 216 is initiated which is a COP estimation of the system after subcooling compared to a COP of the system before artificial subcooling. If the determination is that the system still benefits from subcooling, the controller goes to step 208. If the determination is that the system no longer benefits from subcooling, the controller goes to step 214 where the compressor valve 8 and the condenser outlet valve 9 are closed and the HVAC compressors are turned off.

De-Superheating Reclamation

When the refrigeration system operates subcritically and can not significantly benefit from subcooling, the refrigerant leaves the gas cooler 1 in a low temperature liquid form. The efficiency of the refrigeration system is significantly higher than in transcritical operation. Due to the low pressure and temperature of the refrigerant at this stage, the controller switches the dual reclaim coil inlet point to the compressor discharge at the compressor valve 8 where a greater amount of heat is available from the high pressure and temperature discharge gas. Here, the system operation will be identical to a traditional reclaim coil. The reclaim coil remains in this mode of operation until the refrigeration system becomes transcritical again. The adaptability of the system and its capability of transforming to a conventional reclaim coil makes it an appealing option for both cold-northern climates and hot-southern climates. While the financial benefits of the dual reclaim system are greatest in hot-southern climates, it is not limited to applications in only those areas. In milder climates, the system operates in subcritical mode for the majority of the year but can switch to subcooling reclamation whenever the ambient temperature is high. Subcooling reclamation provides an additional low cost measure that increases efficiency and energy saving.

Recirculating Passive Reclamation

As shown in FIG. 2, a heating only unit with no fresh air and no dehumidification is always in a passive mode since no active cooling occurs inside the HVAC unit. Based on the refrigeration system's efficiency and whether it can significantly benefit from subcooling or not, and also the amount of the space's need for heating, the controller can switch the dual reclaim coil refrigerant inlet between the compressor valve 8 or the condenser outlet valve 9.

Figure 5:
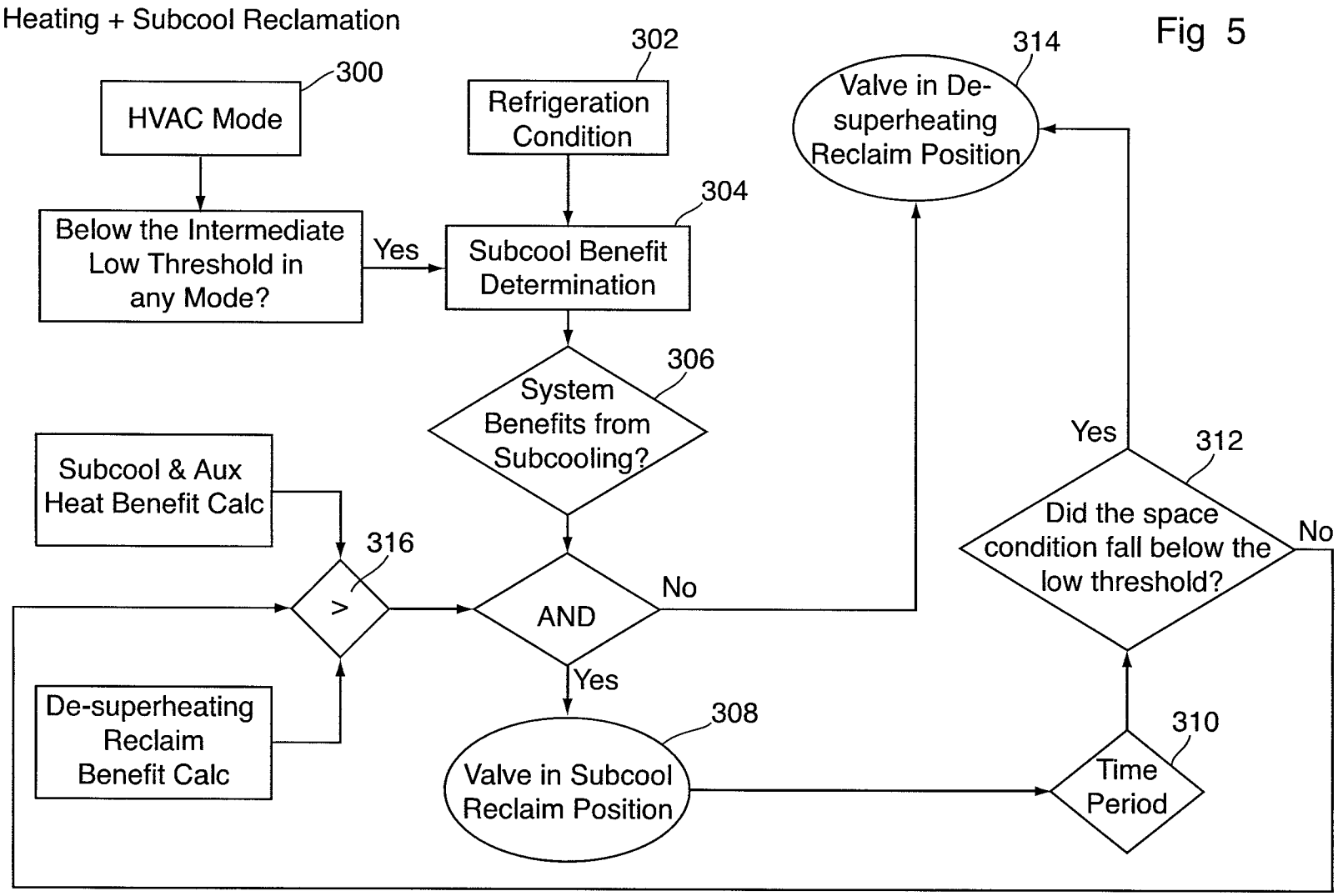
FIG. 5 is a flow diagram of a control process of heating and subcool reclamation.

A decision chart for active and heating and subcool recalamation mode is illustrated in FIG. 5.

With reference to FIG. 5, a first determination is made regarding a HVAC mode 300. For heating and subcool reclamation, a space temperature range must be below the intermediate low threshold in any mode of the HVAC system. A next assessment is made with respect to refrigeration condition 302. For heating and subcool reclamation to provide an energy efficiency benefit, a determination has to be made that the system can benefit from subcooling according to measurements made from data received from the sensors according to one of the criteria described above. If the HVAC mode 300 and refrigeration condition criteria 302 are met, an affirmative or yes answer is obtained for subcool benefit 304 resulting in an affirmative answer to the question of whether the system benefits from subcooling 306. The system then operates in subcooling mode 308 with the compressor valve 8 and the condenser outlet valve 9 being in the second position. After a period of time 310, which is preferably about 30 minutes to 1 hour, an evaluation is made as to whether space condition has fallen below the low threshold 312. If the answer is in the affirmative, then step 314 is implemented and the compressor valve 8 and the condenser outlet valve 9 are moved to the first position for de-superheating reclaim. If the answer at step 312 is in the negative, then step 316 is initiated which is a calculation of subcool and auxiliary benefit compared to a calculation of de-superheating benefit. If the calculation shows a subcooling benefit, the controller switches the valves 8, 9 to the second position for subcool reclaim. If the calculation does not show a subcooling benefit, the controller switches the valves 8, 9 to the first position for de-superheating reclaim.

Figure 6:
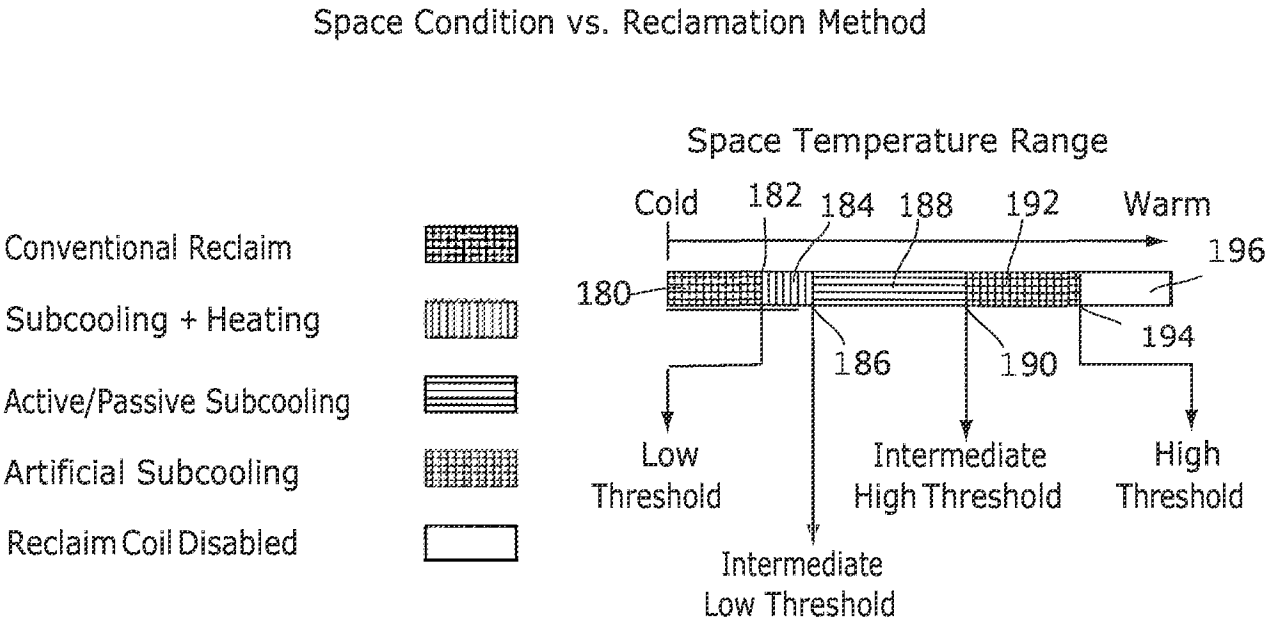
FIG. 6 is bar graph relating space temperature ranges to reclamation method.

FIG. 6 is bar graph relating space temperature ranges to reclamation method.

The low threshold 82 is a user defined temperature below which additional heating would be required in the space to maintain comfort. This is typically in the range of 65-68° F. Below the low threshold is conventional reclaim area 180 where conventional reclaim could be employed for reheating applications. The intermediate low threshold 186 is a defined space temperature that is greater than the low threshold but represents a temperature below which additional heating may be required to maintain comfort. This is typically in the range of 68-70° F. Between the low threshold 182 and the intermediate low threshold 86 is subcooling and heating reclamation area 184 which represents the space temperature range where the booster system could benefit from subcooling and heating reclamation. The intermediate high threshold 190 is a defined space temperature that is lower than the high threshold but represents a temperature in the space that would allow for additional heat to be added to the space without compromising comfort. This is typically in the range of 72-74° F. Between the intermediate low threshold 186 and the intermediate high threshold 190 is the active/passive subcooling reclamation area 188 which represents the space temperature range where the booster system could benefit from active or passive reclamation. The high threshold 194 is the user defined temperature above which mechanical cooling would be required in the space to maintain comfort. This is typically in the range of 74-76° F. Between the intermediate high threshold 190 and the high threshold 194 is the artificial subcooling reclamation area 192 which represents the space temperature range where the booster system could benefit from artificial reclamation. Above the high threshold 194 is space temperature range area 196 where the reclaim coil is disabled.

Example 1: Active Subcooling Reclamation

The following is an example of an application of the control process presented in FIG. 3 for a determination for the controller to apply active subcooling reclamation.

Outside air dry Bulb=95° F.
Outside air dew point=78° F.
HVAC mode: Dehumidification.
Space Dry Bulb=67° F. and Space heating setpoint=68° F.
Space requires heating.
Reclaim coil air side temperature=50-60° F.
Refrigerant temperature at gas cooler exit (9)=98° F.
Refrigerant temperature after subcooling=75-85° F.
HVAC supply temperature after reclaim=60-70° F.
Booster system efficiency improvement=10-30%
Subcooling improves refrigeration efficiency and reclaim remedies overcooling due to dehumidification in HVAC by increasing the supply temperature to provide neutral air.

Example 2: Passive Subcooling Reclamation

Outside air dry Bulb=80° F.
Outside air dew point=52° F.
HVAC mode: Idle (fan only).
Space Dry Bulb=68° F. & Space heating setpoint=68° F.
Reclaim coil air side temperature=70-74° F.
Refrigerant temperature at gas cooler exit (9)=85° F.
Refrigerant temperature after subcooling=76-82° F.
Booster system efficiency improvement=5-15%.
Y<X (efficiency improvement in passive mode is less than active mode due to lower air to refrigerant ΔT).
HVAC supply temperature after reclaim=74-80° F.
Subcooling improves refrigeration efficiency and reclaim increases the HVAC supply temperature, this mode continues until the space temp is above the comfort threshold.

Example 3: Artificial Subcooling Reclamation

Figure 8:
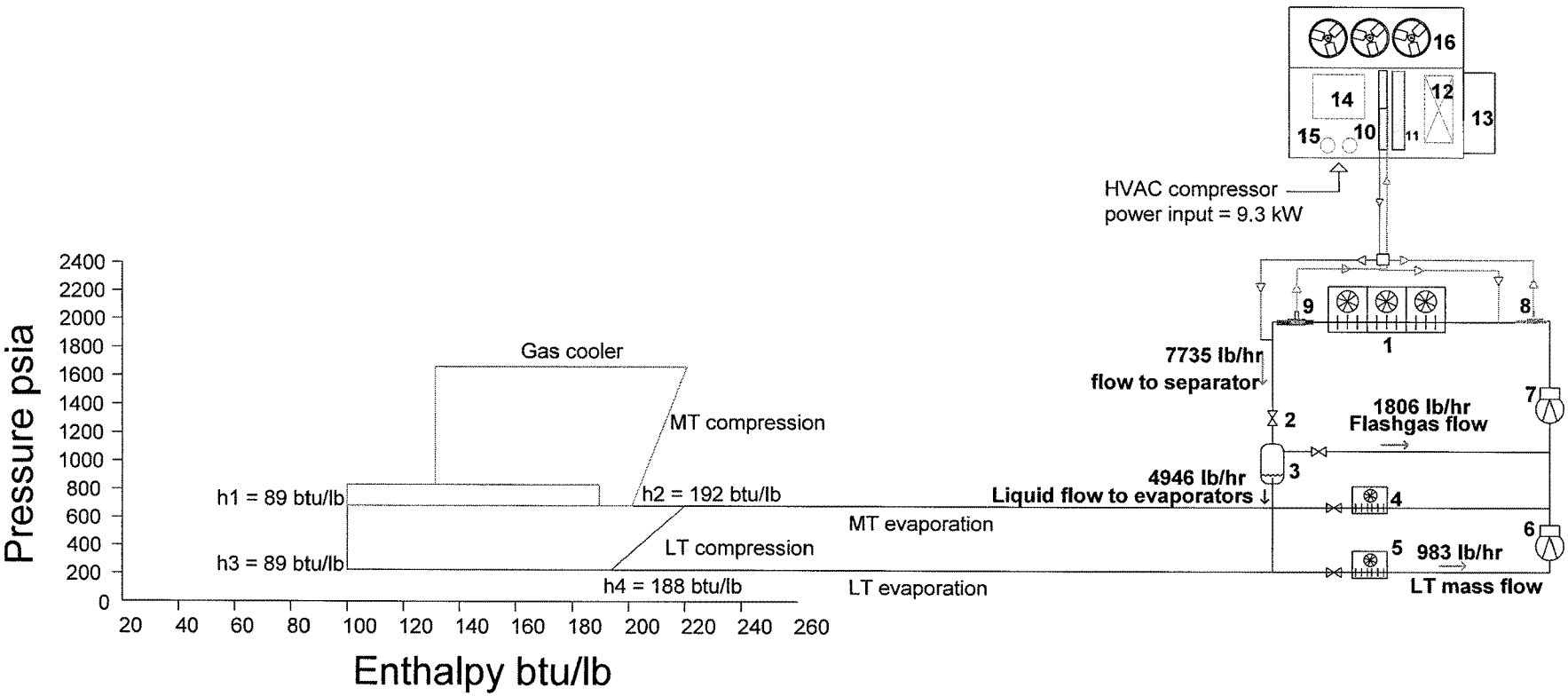
FIG. 8 is a combination of a graph showing a plot of pressure v. enthalpy and a schematic diagram of a transcritical refrigeration system in fluid communication with an air handler unit having a dual reclaim coil.

Outside air dry Bulb=85° F.
Outside air dew point=52° F.
Initial HVAC mode: Idle (fan only).
Space Dry Bulb=72° F. & Space heating setpoint=68° F.
Space does not require heating.
Reclaim air side temp before artificial subcooling=74-78° F.
Refrigerant temperature at gas cooler exit (9)=90° F.
Gas cooler exit is supercritical fluid so subcooling is beneficial.
If optimization process confirms overall saving, the HVAC compressor will initiate.
Booster system efficiency improvement=10-30%
Subcooling improves refrigeration efficiency, HVAC compressor provides ΔT needed for subcooling (between air side and refrigeration side) and prevents HVAC supply temperature from rising drastically. Process continues until the space temp is above the comfort threshold or the energy consumed by HVAC compressors (energy penalty) is more than the savings for booster system compressors (optimization).
With reference to FIG. 8:
Total mass flow=7759 lb/hr (from sensor).
Flash gas mass flow=3108 lb/hr (from sensor).
LT evaporator mass flow=983 lb/hr (from sensor).
MT evaporator mass flow=7759−3108−983=3668 lb/hr.
LT saturation suction pressure (SSP)=210 psi (from sensor located at LT evaporator).
MT saturation suction pressure (SSP)=605 psi (from sensor located at MT evaporator).
LT saturation suction temperature (SST)=−23° F. (from sensor located at LT circuit or from system specs).
MT saturation suction temperature (SST)=25° F. (from sensor located at LT circuit or from system specs).

h1 (saturated liquid enthalpy at 605 psi and 25° F.)=91 btu/lb (from CO2 saturation property table).

h2 (saturated vapor enthalpy at 605 psi and 25° F.)=195 btu/lb (from CO2 saturation property table).

h3 (saturated liquid enthalpy at 210 psi and −23°)=91 btu/lb (from CO2 saturation property table or h3~h1).

h4 (saturated vapor enthalpy at 210 psi and −23°)=191 btu/lb (from CO2 saturation property table or h3~h1).

Before subcooling:

LT capacity before subcooling=983×(191−91)=98,300 btu/hr.

MT capacity before subcooling=3668×(195−91)=381,472 btu/hr.

Total capacity before subcooling (Qc)=98,300+381,472=479,772 btu/hr.

Or if only total mass flow and flash gas mass flow were available:

Total capacity=(7759−3108)×(195−91)=483,704 (deviation<1%).

Lt Compressor power input=6.98 kW (from CT or performance curve).

MT compressor power input=59.9 kW (from CT or performance curve).

Total compressor power input (W)=59.9+6.98=66.88 kW.

Total capacity before subcooling converted to kW=479,772/3412=140 kW.

COP before subcooling=total capacity/total power=140/66.88=2.09.

After subcooling:

LT capacity after subcooling=983×(188−89)=97,317 btu/hr.

MT capacity before subcooling=4946×(192−89)=509,438 btu/hr.

Total capacity before subcooling (Qcs)=97,317+509,438=606,755 btu/hr.

Or if only total mass flow and flash gas mass flow were available:

Total capacity=(7735−1806)×(192−89)=610,687 (deviation<1%).

Lt Compressor power input=6.98 kW (from CT or performance curve).

MT compressor power input=56.5 kW (from CT or performance curve).

Total compressor power input (Ws)=56.5+6.98=63.48 kW.

Total capacity before subcooling converted to kW=606,755/3412=177.8 kW.

COP after subcooling (COPs)=total capacity/total power=177.8/63.48=2.80.

Energy Saving

Estimated energy for the Qs capacity without subcooling (Wh):

Wh=Qc/Cop1=177.8/2.09=84.72 kW.

Refrigeration system saving due to subcooling (Rsaving) =Wh−Ws=84.72−63.48=21.24 kW.

Energy Penalty

HVAC compressor power input (Whvac)=9.3 kW (from CT or performance curve).

Net Saving

Net saving=Rsaving−Whvac=21.24−9.3=11.94 kW.

Example 4: De-Superheating Reclamation

Outside air dry Bulb=60° F.

Outside air dew point=45° F.

Outside air Subcool Setpoint=70° F. (both liquid and gas states exist at the gas cooler exit).

Space DB=65° F. & Space heating setpoint=68° F.

HVAC mode: Heating.

Reclaim coil air side temperature=60-65° F.

Refrigerant temperature at gas cooler exit (9)=65° F.

Flash gas mass flow is minimal.

ΔT between air side and refrigerant side is low (0-5° F.).

Subcooling does not improve the COP significantly.

Outside Air<70° F. and flash gas is minimal, so subcooling is not beneficial.

Space requires high amount of heating capacity.

The system switches to de-superheating mode.

Booster system discharge temperature (8)=205° F.

HVAC supply temperature after reclaim=80° F.

De-superheating recovers more heat for the space and reduces the energy consumption of the HVAC auxiliary heating system.

This mode continues until the space temperature is above the comfort threshold or the space required heating/refrigeration system envelope require other modes While various aspects and embodiments have been disclosed herein, other aspects and embodiments are contemplated. The various aspects and embodiments disclosed herein are for purposes of illustration and are not intended to be limiting.

The invention claimed is:

1. A refrigeration system, comprising:

a condenser;

an expansion valve;

an evaporator;

a compressor;

a refrigerant having a critical temperature of less than 95° F.;

a refrigerant conduit defining a cyclic flow path for the refrigerant from the condenser to the expansion valve to the evaporator to the compressor and back to the condenser;

a compressor valve located in the refrigerant conduit at a position between the compressor and the condenser;

a condenser outlet valve located in the refrigerant conduit at a position between the condenser and the expansion valve;

a flash tank operating as a liquid/vapor separator, the flash tank being fluidly connected to the refrigerant conduit at a position the between expansion valve and the evaporator, the refrigerant conduit further defining a bypass conduit for transmitting gas from the flash tank to the compressor;

a reclaim coil;

a first reclaim coil conduit defining a flow path for the refrigerant from the compressor valve through the reclaim coil and then to the refrigerant conduit at a position between the compressor valve and the condenser whereby the refrigerant flows from the first reclaim coil conduit into the refrigerant conduit and then to the condenser through the refrigerant conduit;

a second reclaim coil conduit defining a flow path for the refrigerant from the condenser outlet valve through the reclaim coil to the refrigerant conduit at a position between the condenser outlet valve and the expansion valve whereby the refrigerant flows from the second reclaim coil conduit into the refrigerant conduit and then to the expansion valve through the refrigerant conduit;

a flash gas flow sensor for measuring a mass flow of gas exiting the flash tank, the flash gas flow sensor being in fluid communication with the bypass conduit; and a controller operatively connected to the flash gas flow sensor for calculating a ratio of flash gas mass flow relative to a total mass flow of the refrigerant based on data received from the flash gas flow sensor, the controller further being operatively connected to the compressor valve and the condenser outlet valve for selectively operating the compressor valve and the condenser outlet valve between first and second positions in response to a calculation of the ratio of flash gas mass flow to the total mass flow of the refrigerant, said compressor valve directing a flow of the refrigerant through the first reclaim coil conduit when in the first position, said compressor valve directing the flow of the refrigerant through the refrigerant conduit to the condenser when said compressor valve is in the second position, said condenser outlet valve directing the flow of the refrigerant through the refrigerant conduit from the compressor to the expansion valve when said condenser outlet valve is in the first position, said condenser outlet valve directing a flow of the refrigerant through the second reclaim coil conduit when said condenser outlet valve is in the second position, wherein the controller operates the compressor valve and the condenser outlet value to the second positions when the ratio of the flash gas mass flow to a total mass flow of the refrigerant exceeds a predetermined valve.

2. The refrigeration system according to claim 1 wherein the refrigerant is carbon dioxide (R-744).

3. The refrigeration system according to claim 1 wherein there are two evaporators in fluid communication with the flash tank through the refrigerant conduit.

4. The refrigeration system according to claim 1 wherein the flash tank has a top gas component in fluid communication with a bypass valve in the refrigerant conduit, the bypass valve being operable to allow gas to flow through the bypass conduit to the compressor.

5. The refrigeration system according to claim 3 wherein the two evaporators are a low temperature evaporator and medium temperature evaporator, the low temperature evaporator being in fluid communication with a second compressor through the refrigerant conduit, the medium temperature evaporator being in fluid communication with the compressor through the refrigerant conduit.

6. The refrigeration system according to claim 1 wherein the reclaim coil is a condenser located in a heating, ventilation, and air conditioning (HVAC) unit.

7. The refrigeration system according to claim 6 wherein the reclaim coil is located adjacent to a cooling coil in the HVAC unit for cooling and dehumidifying an air stream passing over said cooling coil.

8. A method of dual heat reclamation from a refrigeration system, the method comprising:

providing a condenser, an expansion valve; an evaporator and a compressor;

providing a refrigerant conduit defining a cyclic flow path for a refrigerant from the condenser to the expansion valve to the evaporator to the compressor and back to the condenser;

providing a compressor valve located in the refrigerant conduit at a position between the compressor and the condenser;

providing a condenser outlet valve located in the refrigerant conduit at a position between the condenser and the expansion valve;

providing a flash tank operating as a liquid/vapor separator, the flash tank being fluidly connected to the refrigerant conduit at a position between the expansion valve and the evaporator, the refrigerant conduit further defining a bypass conduit for transmitting gas from the flash tank to the compressor;

providing a reclaim coil;

providing a first reclaim coil conduit defining a flow path for the refrigerant from the compressor valve through the reclaim coil and then to the refrigerant conduit at a position between the compressor valve and the condenser whereby the refrigerant flows from the first reclaim coil conduit into the refrigerant conduit and then to the condenser through the refrigerant conduit;

providing a second reclaim coil conduit defining a flow path for the refrigerant from the condenser outlet valve through the reclaim coil to the refrigerant conduit at a position between the condenser outlet valve and the expansion valve whereby the refrigerant flows from the second reclaim coil conduit into the refrigerant conduit and then to the expansion valve through the refrigerant conduit;

providing a flash gas flow sensor for measuring mass flow of a gas exiting the flash tank, the flash gas flow sensor being in fluid communication with the bypass conduit;

providing a controller operatively connected to the flash gas flow sensor for calculating a ratio of flash gas mass flow relative to a total mass flow of the refrigerant based on data received from the flash gas flow sensor, the controller further being operatively connected to the compressor value and the condenser outlet valve for selectively operating the compressor valve and the condenser outlet valve between first and second positions in response to a calculation of the ratio of flash gas mass flow to the total mass flow of the refrigerant;

circulating a refrigerant having a critical temperature of less than 95° F. through the refrigerant conduit;

selectively operating by means of the controller, the compressor valve and the condenser outlet valve between the first and second positions, whereby said compressor valve directs a flow of the refrigerant through the first reclaim coil conduit when in the first position, said compressor valve directs a flow of the refrigerant through the refrigerant conduit to the condenser when said compressor valve is in the second position, and whereby said condenser outlet valve directs a flow of the refrigerant through the refrigerant conduit from the compressor to the expansion valve when said condenser outlet valve is in the first position, said condenser outlet valve directs a flow of the refrigerant through the second reclaim coil conduit when said condenser outlet valve is in the second position, wherein the controller operates the compressor valve and the condenser outlet valve to the second positions when the ratio of the flash gas mass flow to a total mass flow of the refrigerant exceeds a predetermined value.

9. The method according to claim 8 wherein the refrigerant is carbon dioxide (R-744).

10. The method of claim 8 wherein the reclaim coil is a condenser located in a heating, ventilation, and air conditioning (HVAC) unit.

11. The method of claim 8 further comprising the step of the operating by means of the controller, the compressor valve to be in the first position and the condenser outlet valve to be in the first position when the mass flow sensor detects at least one of a temperature, a pressure and a mass flow of a gas exiting the flash tank that is below a cut-off temperature, thereby not indicating significant inefficiency so that the refrigeration system cannot significantly benefit from subcooling.

12. The method of claim 8 further comprising the step of the operating by means of the controller, the compressor valve to be in the second position and the condenser outlet valve to be in the second position when the mass flow sensor detects at least one of a temperature, a pressure and a mass flow of a gas exiting the flash tank that is above a cut-off temperature indicative of the fluid leaving the condenser being in supercritical form, therefore the refrigeration system can significantly benefit from subcooling without comfort in the space being compromised.

13. The method of claim 10 wherein the reclaim coil is located adjacent to a cooling coil for cooling and dehumidifying an air stream passing over said cooling coil, further comprising the step of heating the air stream with the reclaim coil.

14. The refrigeration system according to claim 1 wherein the predetermined value is 15% of the total mass flow of the refrigerant.

15. The method according to claim 8 wherein the predetermined value is 15% of the total mass flow of the refrigerant.

16. A method of dual heat reclamation from a refrigeration system, the method comprising:

providing a condenser, an expansion valve; an evaporator and a compressor;

providing a refrigerant conduit defining a cyclic flow path for a refrigerant from the condenser to the expansion valve to the evaporator to the compressor and back to condenser;

providing a compressor valve located in the refrigerant conduit at a position between the compressor and the condenser;

providing a condenser outlet valve located in the refrigerant conduit at a position between the condenser and the expansion valve;

providing a reclaim coil being a condenser located in a heating, ventilation, and air conditioning (HVAC) unit, the reclaim coil being located adjacent to a cooling coil for cooling and dehumidifying an air stream passing over said cooling coil, providing a first reclaim coil conduit defining a flow path for the refrigerant from the compressor valve through the reclaim coil and then to the refrigerant conduit at a position between the compressor valve and the condenser whereby the refrigerant flows from the first reclaim coil conduit into the refrigerant conduit and then to the condenser through the refrigerant conduit;

providing a second reclaim coil conduit defining a flow path for the refrigerant from the condenser outlet valve through the reclaim coil to the refrigerant conduit at a position between the condenser outlet valve and the expansion valve whereby the refrigerant flows from the second reclaim coil conduit into the refrigerant conduit and then to the expansion valve through the refrigerant conduit;

providing at least one of a flash gas flow sensor for measuring a mass flow of gas exiting a flash tank, the flash gas flow sensor being in fluid communication with the bypass conduit, a refrigerant temperature sensor located in the refrigerant conduit at the exit of the condenser outlet valve for measuring a temperature of the refrigerant in the refrigerant conduit at the exit of the condenser outlet valve and an ambient air temperature sensor located outside of a space in which the refrigeration system is located for measuring an ambient outdoor temperature;

providing a controller operatively connected to the refrigerant temperature sensor and/or the ambient air temperature sensor for receiving data from said sensors, the controller being operatively connected to the condenser outlet valve and to the compressor valve;

circulating a refrigerant having a critical temperature of less than 95° F. through the refrigerant conduit;

determining that a space temperature range is between a user defined intermediate low temperature threshold and user defined high temperature threshold;

determining by means of the controller that the refrigeration system would benefit from subcooling in response to data received from at least one of the flash gas flow sensor, the refrigerant temperature sensor and the ambient air sensor;

selectively operating by means of the controller, the compressor valve and the condenser outlet valve between first and second positions in response data received from at least one of the flash gas flow sensor, the refrigerant temperature sensor and the ambient air sensor, whereby said compressor valve directs a flow of the refrigerant through the first reclaim coil conduit when in the first position, said compressor valve directs a flow of the refrigerant through the refrigerant conduit to the condenser when said compressor valve is in the second position, and whereby said condenser outlet valve directs a flow of the refrigerant through the refrigerant conduit from the compressor to the expansion valve when said condenser outlet valve is in the first position, said condenser outlet valve directs a flow of the refrigerant through the second reclaim coil conduit when said condenser outlet valve is in the second position, said selective operation being made to operate the refrigeration system in subcooling mode with the compressor valve and the condenser outlet valve being in the second positions when at least one of the sensors indicate that the phase of the refrigerant is in a phase of a supercritical fluid thereby indicating that the refrigeration system can operate efficiently in the subcooling mode;

determining after a period of time of operation in the subcooling mode whether the temperature of the interior space has risen above a user defined high temperature threshold as detected by a temperature sensor in the interior space;

operating by means of the controller, the compressor valve and the condenser valve to closed positions thereby terminating a reheat operation in response to a determination the temperature of the interior space has risen above the high temperature threshold;

if a determination is made after the period of time of operation in the subcooling mode that the temperature of the interior space has not risen above the high temperature threshold of as detected by a temperature sensor in the interior space then determining whether the temperature of the interior space has fallen below a user defined low temperature threshold as detected by a temperature sensor in the interior space, operating by means of the controller, the compressor valve and the condenser valve to the first positions in response to a determination the temperature of the interior space has fallen below the low temperature threshold.

17. The method of claim 16 wherein the low temperature threshold is in the range of 65-68° F., the intermediate low temperature threshold is in the range of 68-70° F. and the high temperature threshold is in the range of 74-76° F.

18. The method of claim 16 wherein the period of time is 30 minutes to 60 minutes.

19. A method of dual heat reclamation from a refrigeration system, the method comprising:

providing a condenser, an expansion valve; an evaporator and a compressor;

providing a refrigerant conduit defining a cyclic flow path for a refrigerant from the condenser to the expansion valve to the evaporator to the compressor and back to condenser;

providing a compressor valve located in the refrigerant conduit at a position between the compressor and the condenser;

providing a condenser outlet valve located in the refrigerant conduit at a position between the condenser and the expansion valve;

providing a reclaim coil being a condenser located in a heating, ventilation, and air conditioning (HVAC) unit, the reclaim coil being located adjacent to a cooling coil for cooling and dehumidifying an air stream passing over said cooling coil, providing a first reclaim coil conduit defining a flow path for the refrigerant from the compressor valve through the reclaim coil and then to the refrigerant conduit at a position between the compressor valve and the condenser whereby the refrigerant flows from the first reclaim coil conduit into the refrigerant conduit and then to the condenser through the refrigerant conduit;

providing a second reclaim coil conduit defining a flow path for the refrigerant from the condenser outlet valve through the reclaim coil to the refrigerant conduit at a position between the condenser outlet valve and the expansion valve whereby the refrigerant flows from the second reclaim coil conduit into the refrigerant conduit and then to the expansion valve through the refrigerant conduit;

providing at least one of a flash gas flow sensor for measuring a mass flow of gas exiting a flash tank, the flash gas flow sensor being in fluid communication with the bypass conduit, a refrigerant temperature sensor located in the refrigerant conduit at the exit of the condenser outlet valve for measuring a temperature of the refrigerant in the refrigerant conduit at the exit of the condenser outlet valve and an ambient air temperature sensor located outside of a space in which the refrigeration system is located for measuring an ambient outdoor temperature;

providing a controller operatively connected to the refrigerant temperature sensor and/or the ambient air temperature sensor for receiving data from said sensors, the controller being operatively connected to the condenser outlet valve and to the compressor valve;

circulating a refrigerant having a critical temperature of less than 95° F. through the refrigerant conduit;

operating the HVAC unit in dehumidification mode;

determining by means of the controller that the refrigeration system would benefit from subcooling in response to data received from at least one of the flash gas flow sensor, the refrigerant temperature sensor and the ambient air sensor;

selectively operating by means of the controller, the compressor valve and the condenser outlet valve between first and second positions in response data received from at least one of the flash gas flow sensor, the refrigerant temperature sensor and the ambient air sensor, whereby said compressor valve directs a flow of the refrigerant through the first reclaim coil conduit when in the first position, said compressor valve directs a flow of the refrigerant through the refrigerant conduit to the condenser when said compressor valve is in the second position, and whereby said condenser outlet valve directs a flow of the refrigerant through the refrigerant conduit from the compressor to the expansion valve when said condenser outlet valve is in the first position, said condenser outlet valve directs a flow of the refrigerant through the second reclaim coil conduit when said condenser outlet valve is in the second position, said selective operation being made to operate the refrigeration system in subcooling mode with the compressor valve and the condenser outlet valve being in the second positions when at least one of the sensors indicate that the phase of the refrigerant is in a phase of a supercritical fluid thereby indicating that the refrigeration system can operate efficiently in the subcooling mode;

determining after a period of time of operation in the subcooling mode whether the temperature of the interior space has risen above a user defined high temperature threshold as detected by a temperature sensor in the interior space;

operating by means of the controller, the compressor valve and the condenser valve to closed positions thereby terminating a reheat operation in response to a determination the temperature of the interior space has risen above the high temperature threshold;

if a determination is made after the period of time of operation in the subcooling mode that the temperature of the interior space has not risen above the high temperature threshold of as detected by a temperature sensor in the interior space then determining whether the temperature of the interior space has fallen below a user defined low temperature threshold as detected by a temperature sensor in the interior space, operating by means of the controller, the compressor valve and the condenser valve to the first positions in response to a determination the temperature of the interior space has fallen below the low temperature threshold.

20. The method of claim 19 wherein the low temperature threshold is in a range of 65-68° F., the intermediate low temperature threshold is in a range of 68-70° F. and the high temperature threshold is in a range of 74-76° F.

21. The method of claim 19 wherein the period of time is 30 minutes to 60 minutes.

* * * * *